US010768568B1

(12) United States Patent
Mizutani

(10) Patent No.: US 10,768,568 B1
(45) Date of Patent: Sep. 8, 2020

(54) SHEET BINDING APPARATUS AND IMAGE FORMING SYSTEM

(71) Applicant: TOSHIBA TEC KABUSHIKI KAISHA, Shinagawa-ku, Tokyo (JP)

(72) Inventor: Kikuo Mizutani, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 29 days.

(21) Appl. No.: 16/280,067

(22) Filed: Feb. 20, 2019

(51) Int. Cl.

| | |
|---|---|
| ***B65H 29/12*** | (2006.01) |
| ***G03G 15/00*** | (2006.01) |
| ***B65H 37/04*** | (2006.01) |
| ***B65H 35/00*** | (2006.01) |

(52) U.S. Cl.
CPC ..... *G03G 15/6544* (2013.01); *B65H 29/12* (2013.01); *B65H 29/125* (2013.01); *B65H 35/0066* (2013.01); *B65H 37/04* (2013.01); *B65H 2301/43821* (2013.01); *G03G 2215/00839* (2013.01); *G03G 2215/00848* (2013.01)

(58) Field of Classification Search
CPC .. B65H 29/12; B65H 29/125; B65H 35/0066; B65H 2301/43821; G03G 15/6544; G03G 2215/00839; G03G 2215/00848
USPC ..... 270/58.07, 58.08
See application file for complete search history.

(56) References Cited

U.S. PATENT DOCUMENTS

| | | | | |
|---|---|---|---|---|
| 4,427,405 | A * | 1/1984 | Hoshi | B41F 13/56 493/424 |
| 5,449,162 | A * | 9/1995 | Saito | B65H 3/5261 271/122 |
| 6,024,525 | A * | 2/2000 | Yamanaka | B42C 9/0075 412/11 |
| 7,484,721 | B2 * | 2/2009 | Tsukui | B65H 33/04 270/58.07 |
| 7,726,638 | B2 * | 6/2010 | Itagaki | B65H 45/18 270/20.1 |
| 8,393,620 | B2 * | 3/2013 | Doucet | B41F 13/24 271/265.04 |
| 10,031,465 | B2 | 7/2018 | Sunaoshi et al. | |
| 10,202,252 | B2 * | 2/2019 | Mizutani | B65H 29/12 |
| 10,252,877 | B2 * | 4/2019 | Sunaoshi | B65H 35/0066 |
| 2007/0035079 | A1 * | 2/2007 | Yamada | B26D 1/205 270/58.07 |
| 2018/0086590 | A1 | 3/2018 | Mizutani | |
| 2018/0148294 | A1 | 5/2018 | Sunaoshi et al. | |

* cited by examiner

*Primary Examiner* — Leslie A Nicholson, III
(74) *Attorney, Agent, or Firm* — Amin, Turocy & Watson, LLP

(57) ABSTRACT

According to one embodiment, a sheet binding apparatus includes a first roller, a second roller, and a nip-pressure adjusting section. The first roller attaches a tape to an edge portion of a sheet bundle. The second roller is opposed to the first roller in the sheet bundle thickness direction. The nip-pressure adjusting section is capable of adjusting, on the basis of the position of an edge portion leading end of the sheet bundle, a pressing force of a nip formed by the first roller and the second roller. Before the sheet bundle is inserted between the first roller and the second roller, an interval between the first roller and the second roller is equal to or smaller than the thickness of the sheet bundle.

20 Claims, 17 Drawing Sheets

SHEET BINDING APPARATUS AND IMAGE FORMING SYSTEM

FIELD

Embodiments described herein relate generally to a sheet binding apparatus, methods of binding a sheet stack, and an image forming system.

BACKGROUND

There is known a sheet binding apparatus that binds an edge portion of a sheet bundle with an adhesive tape up to now. The sheet binding apparatus includes a bundle forming section and a tape attaching section. The bundle forming section stacks a plurality of sheets to forma sheet bundle. The bundle forming section forms a side portion of the sheet bundle in a step shape in order to secure a surface area during tape attachment. The tape attaching section attaches the adhesive tape to an edge portion of the sheet bundle to bind the sheet bundle. The tape attaching section includes a tape holding section that holds the adhesive tape. The tape attaching section includes a first roller and a second roller opposed to each other in the sheet bundle thickness direction. The adhesive tape is peeled from the tape holding section by inserting the sheet bundle, which is shifted in the step shape, toward the adhesive tape held by the tape holding section. Thereafter, the sheet bundle is rushed inbetween the first roller and the second roller together with the adhesive tape to stuck the adhesive tape to the edge portion of the sheet bundle.

However, the following problem is likely to occur depending on the magnitude of a pressing force on the sheet bundle inbetween the first roller and the second roller (between the rollers). For example, if the pressing force on the sheet bundle between the rollers is too small, the adhesive tape cannot be sufficiently adhered to the edge portion of the sheet bundle. On the other hand, for example, if the pressing force on the sheet bundle between the rollers is too large, the sheet bundle cannot be rushed into between the first roller and the second roller.

DETAILED DESCRIPTION

Figure 1:
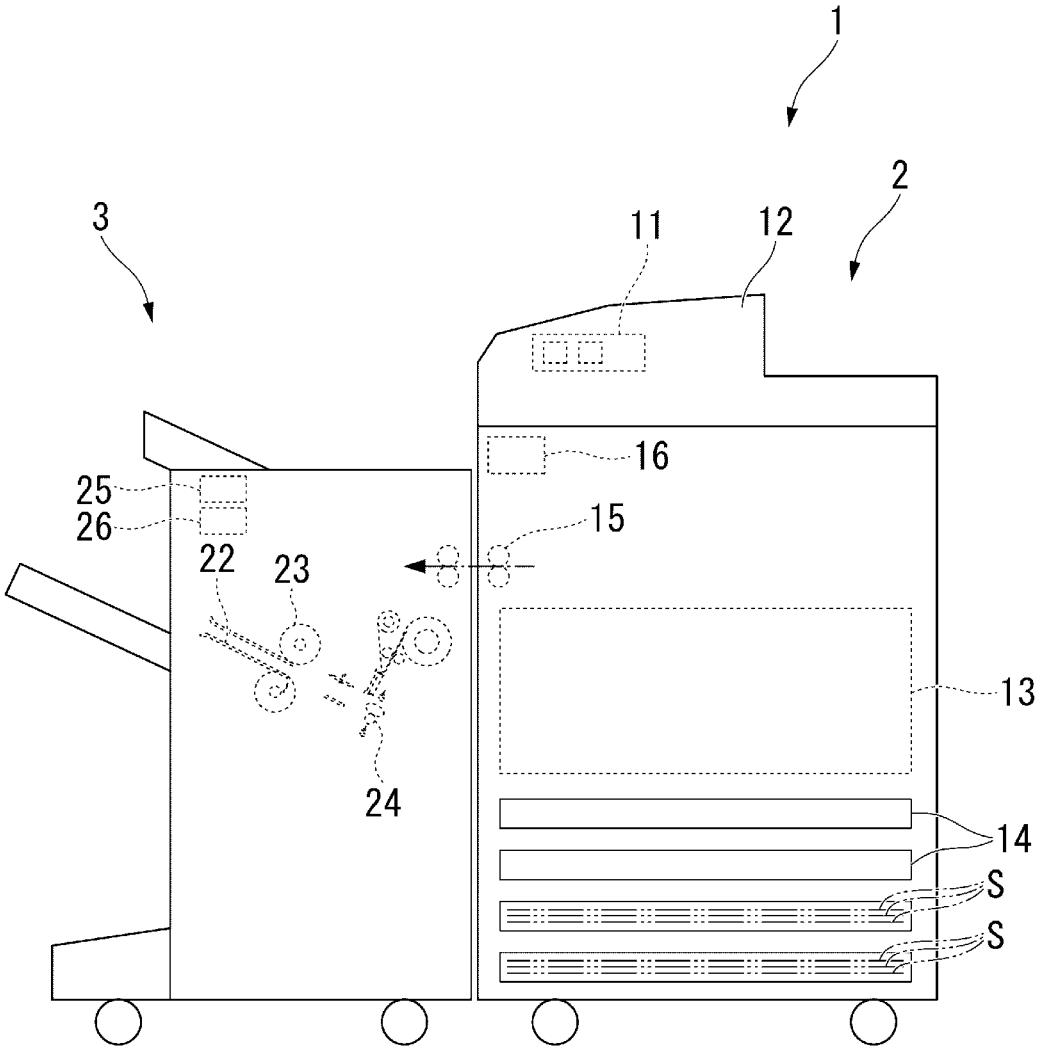
FIG. 1 is a front view showing an image forming system in a first embodiment.

In general, according to one embodiment, a sheet binding apparatus includes a first roller, a second roller, and a nip-pressure adjusting section. The first roller attaches a tape to an edge portion of a sheet bundle. The second roller is opposed to the first roller in the sheet bundle thickness direction. The nip-pressure adjusting section is capable of adjusting, on the basis of a position of an edge portion leading end of the sheet bundle, a pressing force of a nip formed by the first roller and the second roller. Before the sheet bundle is inserted between the first roller and the second roller, an interval between the first roller and the second roller is equal to or smaller than the thickness of the sheet bundle.

Sheet binding apparatuses and image forming systems in embodiments are explained below with reference to the drawings. In the figures, the same components are denoted by the same reference numerals and signs. Redundant explanation of the components is sometimes omitted. In this application, various sheet-like media including paper are referred to as "sheet".

First, one embodiment is explained with reference to FIGS. 1 to 10.

FIG. 1 is a front view showing an image forming system 1 in this embodiment. The image forming system 1 in this embodiment includes a sheet binding apparatus 3 that binds an edge portion 5*a* (see FIG. 9) of a sheet bundle 5 with a tape. For example, the sheet binding apparatus 3 is a post-processing apparatus that is disposed beside an image forming apparatus 2 and performs post-processing on sheets S conveyed from the image forming apparatus 2.

The image forming apparatus 2 is briefly explained first.

As shown in FIG. 1, the image forming apparatus 2 includes a control panel 11, a scanner section 12, a printer section 13, a paper feeding section 14, a paper discharging section 15, and a control section 16.

The control panel 11 includes various keys. The control panel 11 receives operation of a user.

The scanner section 12 reads image information of a copying target object.

The printer section 13 forms an image on the sheet S on the basis of image information received from the scanner section 12 or an external apparatus.

The paper feeding section 14 supplies the sheet S to the printer section 13.

The paper discharging section 15 conveys the sheet S discharged from the printer section 13 to the sheet binding apparatus 3.

The control section 16 controls various operations of the control panel 11, the scanner section 12, the printer section 13, the paper feeding section 14, and the paper discharging section 15.

The sheet binding apparatus 3 is explained.

The sheet binding apparatus 3 includes a bundle forming section 22, a sheet shifting section 23, a tape processing section 24, a nip-pressure adjusting section 80 (see FIG. 2), a storing section 25, and a control section 26.

The bundle forming section 22 is explained.

Figure 2:
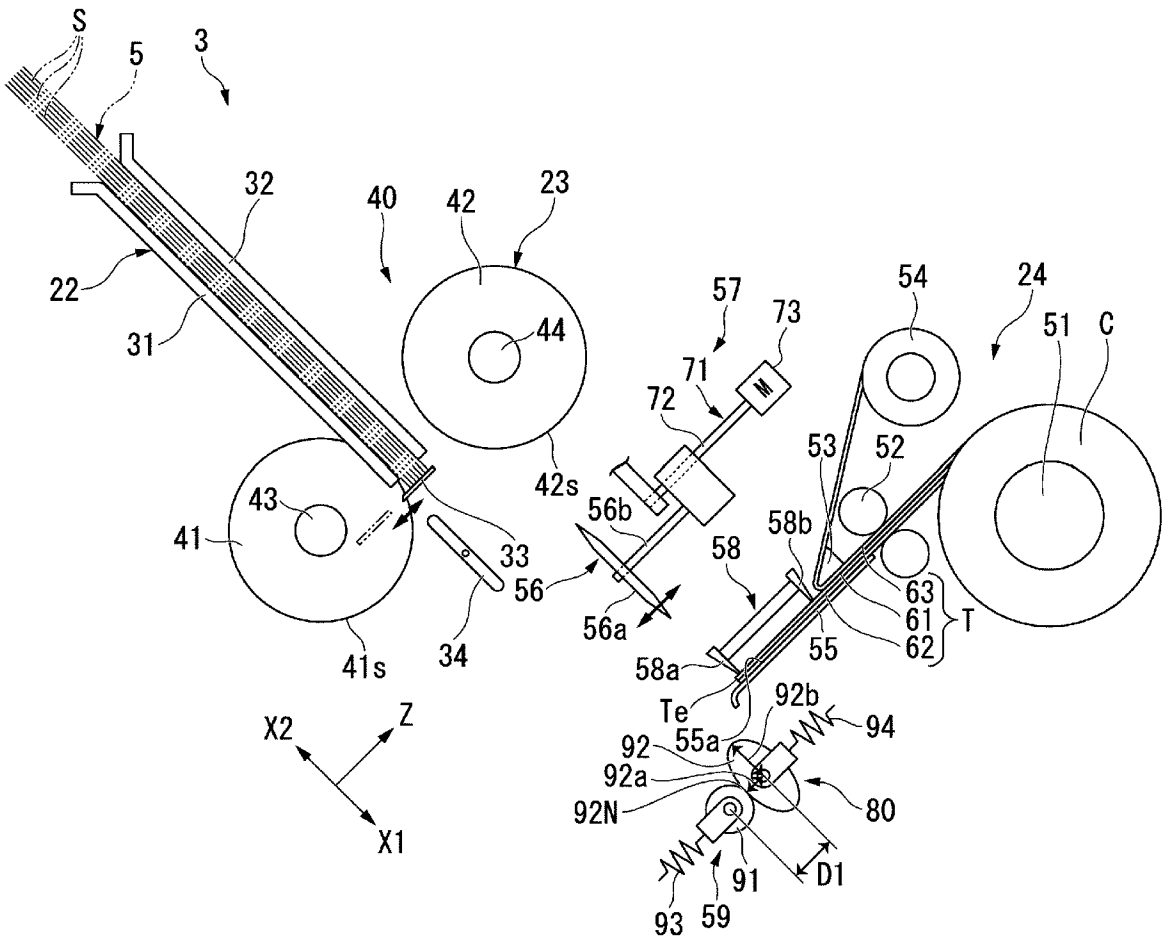
FIG. 2 is a front view showing an internal configuration of a sheet binding apparatus in the first embodiment.

FIG. 2 is a front view showing an internal configuration of the sheet binding apparatus 3.

As shown in FIG. 2, the bundle forming section 22 stacks a plurality of sheets S to form the sheet bundle 5. The bundle forming section 22 includes a main guide 31, a sub-guide 32, a stopper 33, and a switching member 34.

The main guide 31 guides the sheet S along a sheet conveying direction X1. The plurality of sheets S are loaded in order on the main guide 31 to form the sheet bundle 5. The main guide 31 guides the sheet bundle 5 toward between a first roller 91 and a second roller 92. The main guide 31 guides the sheet bundle 5 to cause an edge portion leading end of the sheet bundle 5 to face the inner side of an inter-center width D1 between the first roller 91 and the second roller 92. The downstream-side end portion of the main guide 31 in the sheet conveying direction X1 is formed in a comb teeth shape to avoid a first roller 41 of the sheet shifting section 23.

The sub-guide 32 is opposed to the main guide 31 in a thickness direction Z of the sheet bundle 5 (hereinafter referred to as sheet bundle thickness direction Z). A space in which the sheets are loaded is provided between the main guide 31 and the sub-guide 32. The downstream-side end portion of the sub-guide 32 in the sheet conveying direction X1 is formed in a comb tooth shape to avoid a second roller 42 of the sheet shifting section 23.

The stopper 33 is provided at the downstream-side end portion of the main guide 31 in the sheet conveying direction X1. The stopper 33 is movable between a restricting position (indicated by a solid line in FIG. 2) and a releasing position (indicated by an alternate long and two short dashes line in FIG. 2) by a not-shown moving mechanism. In the restricting position, the stopper 33 projects further upward than the upper surface of the main guide 31. In the restricting position, the end portions of the sheets S come into contact with the stopper 33, whereby the stopper 33 blocks the sheets S. Therefore, the sheets S stay on the main guide 31 and the sheet bundle 5 is formed. On the other hand, in the releasing position, the stopper 33 retracts further downward than the upper surface of the main guide 31. In the releasing position, the stopper 33 allows the sheet bundle 5 on the main guide 31 to pass toward the switching member 34.

The switching member 34 switches a conveying path of the sheet bundle 5. A direction in which the sheet bundle 5 is conveyed toward the tape processing section 24 (specifically, a tape attaching section 59) is referred to as "first conveying direction (inserting direction)". On the other hand, a direction in which the sheet bundle 5 is conveyed to a position (e.g., below the bundle forming section 22) different from the tape attaching section 59 is referred to as "second conveying direction). The switching member 34 switches the conveying path of the sheet bundle 5 between the first conveying direction and the second conveying direction.

The sheet shifting section 23 is explained.

The sheet shifting section 23 shifts the plurality of sheets S in the sheet conveying direction X1 in order little by little to form a state in which the plurality of sheets S forming the sheet bundle 5 are shifted from one another at the edge portion 5*a* of the sheet bundle 5. For example, the sheet shifting section 23 forms a state in which the plurality of sheets S are shifted in a step shape at the edge portion 5*a* of the sheet bundle 5.

The sheet shifting section 23 includes the first roller 41 and the second roller 42. The first roller 41 and the second roller 42 form an example of a "bundle conveying section 40" in cooperation with each other. The bundle conveying section 40 conveys the sheet bundle 5 located between the main guide 31 and the sub-guide 32 toward between the first roller 91 and the second roller 92.

The first roller 41 is attached to a first shaft 43. For example, the first roller 41 is a driving roller driven by a not-shown motor via the first shaft 43. The first roller 41 is fixed in a fixed position. The material of the first roller 41 is not particularly limited. For example, the first roller 41 is formed of ethylene propylene diene rubber (EPDM).

The second roller 42 is attached to a second shaft 44. For example, the second roller 42 is a driven roller that rotates following the rotation of the first roller 41. The second roller 42 is movable in a direction approaching the first roller 41 and a direction away from the first roller 41 by a not-shown moving mechanism. The second roller 42 is moved toward the first roller 41 to come into contact with the sheet bundle 5 from the opposite side of the first roller 41.

An outer circumferential surface 42*s* of the second roller 42 is softer than an outer circumferential surface 41*s* of the first roller 41 and is deformable along the surface of the sheet bundle 5. For example, the second roller 42 is formed of sponge, rubber having a hollow on the inside, or the like. If the second roller 42 is brought close to the first roller 41, the outer circumferential surface 42*s* of the second roller 42 is deformed in an arcuate shape conforming to the outer circumferential surface 41*s* of the first roller 41.

Figure 3A:
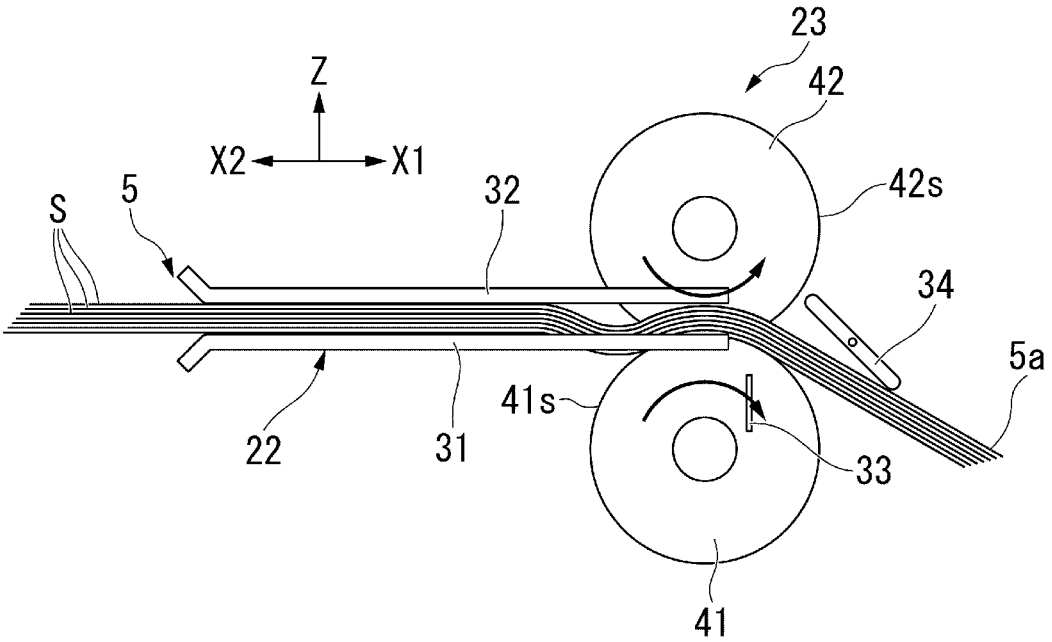
FIGS. 3A and 3B are side views showing operation for changing a shift amount among sheets, FIG. 3A being a diagram showing the operation performed if the shift amount among the sheets is relatively small and FIG. 3B being a diagram showing the operation performed if the shift amount among the sheets is relatively large.
Figure 3B:
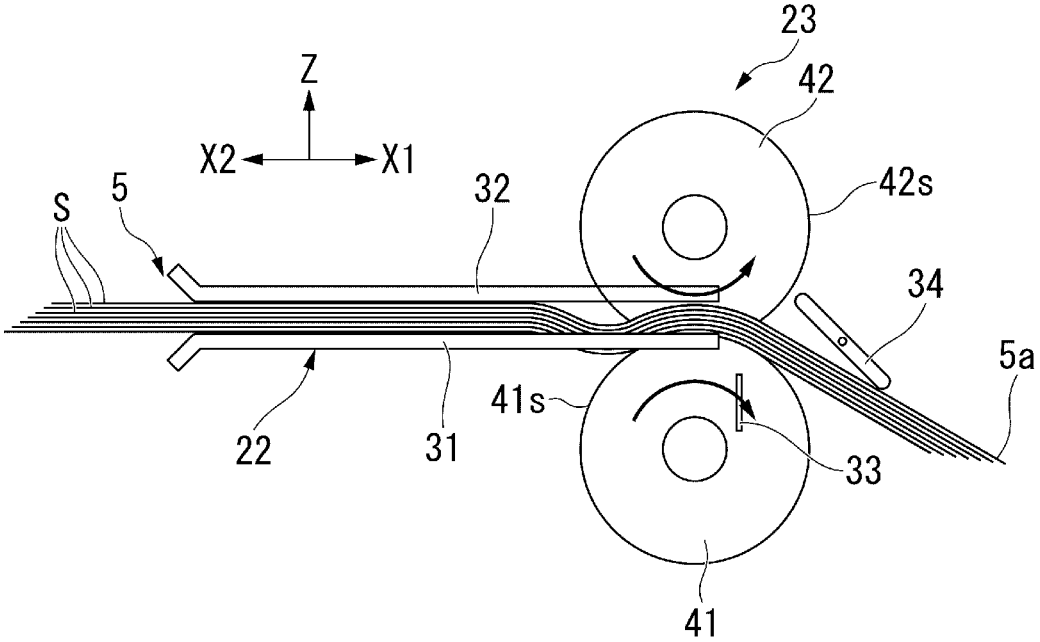

FIGS. 3A and 3B are side views showing operation for changing a shift amount d among the sheets S with the sheet shifting section 23. FIG. 3A shows the operation performed if the shift amount d among the sheets S is relatively small. On the other hand, FIG. 3B shows the operation performed if the shift amount d among the sheets S is relatively large.

As shown in FIG. 3, the sheet shifting section 23 can reduce the shift amount d among the sheets S by setting a rotation angle of the first roller 41 smaller than a reference amount set in advance. On the other hand, the sheet shifting section 23 can increase the shift amount d among the sheets S by setting the rotation angle of the first roller 41 larger than the reference amount.

The tape processing section 24 is explained.

As shown in FIG. 2, the tape processing section 24 includes an unwinding section 51, a tape conveying section 52, a separating member 53, a winding section 54, a guide table 55, a cutter 56, a cutting-length changing section 57, a tape holding section 58, and a tape attaching section 59.

The unwinding section 51 is an example of a "tape supplying section". For example, the unwinding section 51 holds a web roll obtained by winding a belt-like tape T (hereinafter simply referred to as "tape T"). The unwinding section 51 supplies the tape T in the length direction of the tape T. In a state in which the tape T is held by the unwinding section 51, the tape T includes an adhesive layer 61, a protection film (a first film) 62, and a peeling film (a second film) 63. The protection film 62 covers the adhesive layer 61 from one side. The protection film 62 is integral with the adhesive layer 61 during use of the tape T. On the other hand, the peeling film 63 covers the adhesive layer 61 from the opposite side of the protection film 62. The peeling film 63 is peeled from the adhesive layer 61 before the use of the tape T. The peeling film 63 is wound by the separating member 53 and the winding section 54.

The tape conveying section 52 conveys, along the length direction of the tape T, the tape T supplied from the unwinding section 51. For example, the length direction of the tape T is a direction substantially parallel to the sheet bundle thickness direction Z. For example, the tape conveying section 52 is a conveying roller pair that conveys the tape T.

The guide table 55 is an example of a tape conveying guide forming a conveying path of the tape T. The guide table 55 guides the tape T from which the peeling film 63 is separated. The guide table 55 supports the tape T during holding and during cutting of the tape T. A conveying direction of the tape T (the length direction of the tape T) crosses the vertical plane.

The cutter 56 cuts the belt-like tape T supplied from the unwinding section 51 to forma sheet-like tape T. For example, the cutter 56 is a rotor cutter. The cutter 56 includes a cutting edge 56*a* and a supporting shaft 56*b*. The supporting shaft 56*b* is rotated by a not-shown motor, whereby the cutting edge 56*a* is driven to rotate. The configuration of the cutter 56 is not limited to the example explained above. The configuration of the cutter 56 may be any configuration if the cutter 56 can cut the tape T supplied from the unwinding section 51. The cutter 56 is movable in a direction approaching the tape T and a direction away from the tape T by a not-shown moving mechanism.

The cutting-length changing section 57 changes length L (see FIG. 7) of the tape T cut by the cutter 56. "The length L of the tape" in this application is the length (the width) of the tape T in the sheet bundle thickness direction Z. In other words, "the length L of the tape" is length in a direction in which the tape T wraps the edge portion 5*a* of the sheet bundle 5 from a first surface 7*a* toward a second surface 7*b* of the sheet bundle 5.

The cutting-length changing section 57 includes a moving mechanism 71 that changes a relative position of the cutter 56 with respect to a leading end Te of the tape T supplied from the unwinding section 51. For example, the moving mechanism 71 moves the cutter 56 to change the relative position of the cutter 56 with respect to the leading end Te of the tape T. For example, the moving mechanism 71 moves the cutter 56 along the sheet bundle thickness direction Z. "The relative position of the cutter 56 with respect to the leading end Te of the tape T" is, for example, a relative position of the cutter 56 with respect to the leading end Te of the tape T when the tape T is cut by the cutter 56.

In this embodiment, the moving mechanism 71 includes a supporting member 72 that supports the cutter 56 and a driving source 73 that moves the cutter 56 via the supporting member 72. For example, the supporting member 72 is a ball screw coupled to the cutter 56. The driving source 73 is a motor that drives the ball screw to move the cutter 56. The configurations of the supporting member 72 and the driving source 73 are not limited to the example explained above. For example, the supporting member 72 may be a cam or the like that is in contact with the cutter 56. The driving source 73 may be a solenoid or the like that moves the cutter 56 via the supporting member 72. In this case, the supporting member 72 is a coupling member that couples the cutter 56 and the solenoid.

The configuration of the moving mechanism 71 is not limited to the example explained above. For example, the moving mechanism 71 may change the relative position of the cutter 56 with respect to the leading end Te of the tape T by, for example, changing a let-out length of the tape T with respect to the cutter 56 fixed in a fixed position.

In this embodiment, the cutting-length changing section 57 is controlled by the control section 26 (see FIG. 1). For example, the control section 26 controls the driving source 73 of the cutting-length changing section 57 to move the cutter 56 and change the length L of the tape T cut by the cutter 56. For example, the operation of the cutting-length changing section 57 explained below is performed by controlling the cutting-length changing section 57 with the control section 26.

In this embodiment, the cutting-length changing section 57 changes, on the basis of the shift amount d among the sheets S changed by the control section 26, the length of the tape T cut by the cutter 56. For example, if the shift amount d among the sheets S is increased by the control section 26, the cutting-length changing section 57 increases the length L of the tape T cut by the cutter 56. On the other hand, if the shift amount d among the sheets S is reduced by the control section 26, the cutting-length changing section 57 reduces the length L of the tape T cut by the cutter 56.

The tape holding section 58 supports the tape T in a state in which the posture of the tape T is retained substantially flat. The tape holding section 58 is movable along the length direction of the tape T by a not-shown moving mechanism. The tape holding section 58 is movable in a direction approaching the tape T and a direction away from the tape T by the not-shown moving mechanism.

The tape holding section 58 includes a first tape supporting section 58*a* and a second tape supporting section 58*b* that support the tape T. The first tape supporting section 58*a* and the second tape supporting section 58*b* respectively extend along an inserting direction of the sheet bundle 5 (the sheet conveying direction X1). The first tape supporting section 58*a* and the second tape supporting section 58*b* are disposed at an interval from each other in the conveying direction of the tape T. The first tape supporting section 58*a* and the second tape supporting section 58*b* respectively have sharp shapes tapered toward a bonding surface of the tape T (an adhesive surface of the adhesive layer 61).

The tape attaching section 59 (a tape wrapping section) includes the first roller 91, the second roller 92, a first spring 93 (a first urging member), and a second spring 94 (a second urging member). The first roller 91 and the second roller 92 are disposed side by side in the conveying direction of the tape T (the sheet bundle thickness direction Z).

The first roller 91 has a perfect circle shape. If the tape T is attached to the edge portion 5*a* of the sheet bundle 5, the first roller 91 is opposed to the step-like end face of the sheet bundle 5.

The second roller 92 has a shape, the radius of which before insertion of the sheet bundle 5 is smaller than a threshold and the radius of which after the insertion of the sheet bundle 5 is equal to or larger than the threshold. The radius before the insertion of the sheet bundle 5 means a distance from a rotating shaft 92*c* (an axis) before the insertion of the sheet bundle 5 to a nip 90N. The radius after the insertion of the sheet bundle 5 means a distance from the rotating shaft 92*c* (the axis) after the insertion of the sheet bundle 5 to the nip 90N. In this embodiment, the second roller 92 has an elliptical shape.

The second roller 92 includes a minimum radius section 92*a* having a minimum radius and a maximum radius section 92*b* having a maximum radius. The minimum radius section 92*a* is a radius on a minor axis side of the second roller 92. The maximum radius section 92*b* is a radius on a major axis side of the second roller 92. Before the sheet bundle 5 is inserted between the first roller 91 and the second roller 92, the minimum radius section 92*a* forms the nip 90N. If the tape T is attached to the edge portion 5*a* of the sheet bundle 5, the second roller 92 is opposed to the surface on the opposite side of the step-like end face of the sheet bundle 5 (see FIG. 9).

The first spring 93 urges the first roller 91 toward the second roller 92. The second spring 94 urges the second roller 92 toward the first roller 91. The first roller 91 and the first spring 93 form an example of a "first urging section" in cooperation with each other. The second roller 92 and the second spring 94 form an example of a "second urging section" in cooperation with each other. If the tape T is attached, the edge portion 5*a* of the sheet bundle 5 is inserted between the first roller 91 and the second roller 92 together with the tape T. Consequently, the tape T is bent to wrap the edge portion 5*a* of the sheet bundle 5 by the tape attaching section 59. The tape T is attached to the edge portion 5*a* of the sheet bundle 5.

The nip-pressure adjusting section 80 is explained.

The nip-pressure adjusting section 80 is capable of adjusting, on the basis of the position of an edge portion leading end 5*e* (see FIG. 4) of the sheet bundle 5, a pressing force (hereinafter referred to as "nip pressure" as well) of the nip 90N formed by the first roller 91 and the second roller 92. The nip pressure means a pressing force against the sheet bundle 5 between the first roller 91 and the second roller 92. In this embodiment, an outer circumferential portion (an elliptical-shape forming portion) of the second roller 92 forms an example of the nip-pressure adjusting section 80.

Figure 4:
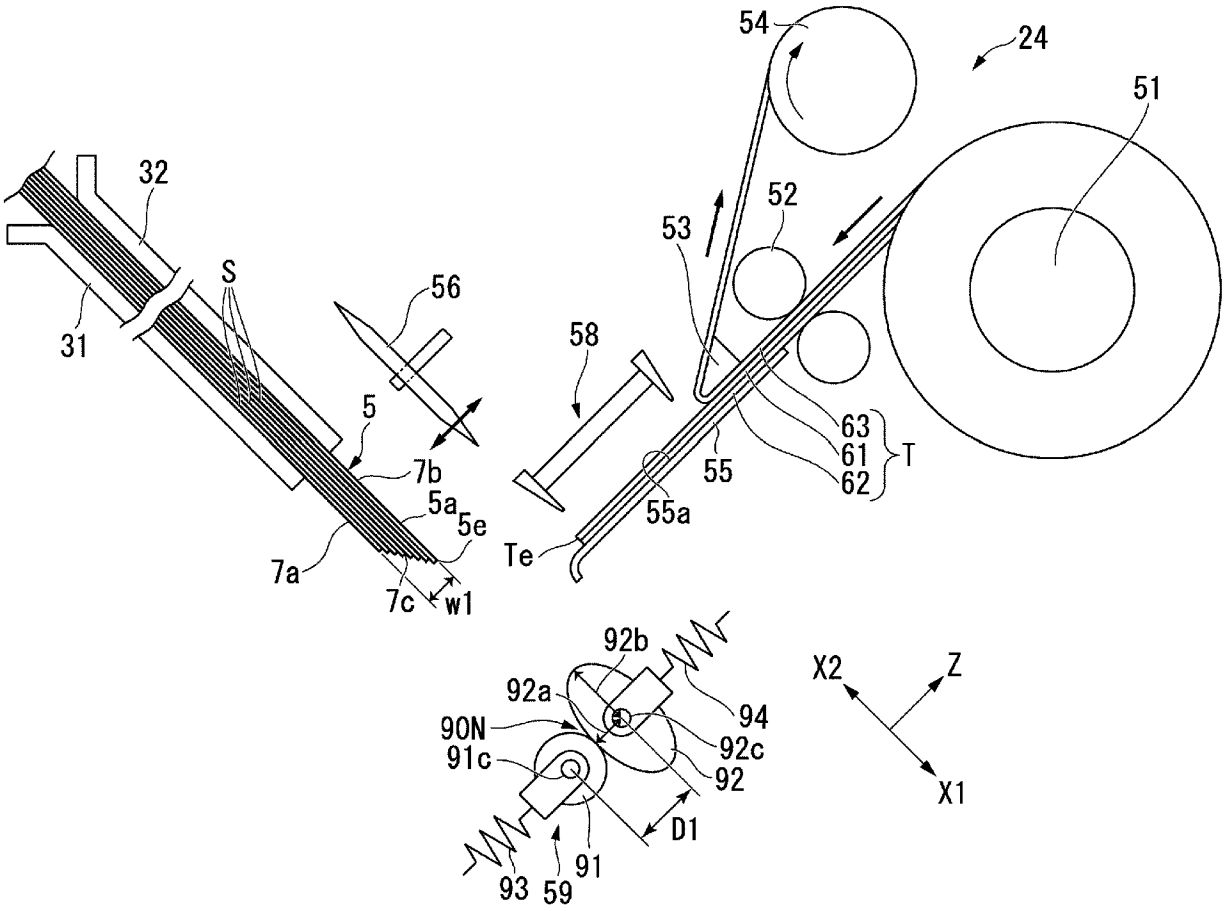
FIG. 4 is a front view showing the operation of the sheet binding apparatus.

In FIG. 4, reference sign W1 indicates the thickness of the sheet bundle 5. Before the sheet bundle 5 is inserted between the first roller 91 and the second roller 92, an interval between the first roller 91 and the second roller 92 (hereinafter referred to as "roller interval" as well) is equal to or smaller than the thickness W1 of the sheet bundle 5. In this embodiment, the roller interval is zero before the sheet bundle 5 is inserted between the first roller 91 and the second roller 92. In other words, before the sheet bundle 5 is inserted between the first roller 91 and the second roller 92, the first roller 91 and the second roller 92 are in contact with each other.

The control section 26 (see FIG. 1) is formed by a control circuit or the like including a CPU, a ROM, and a RAM provided in the sheet binding apparatus 3. For example, a processor such as a CPU executes a computer program, whereby the control section 26 controls the operation of the sheet binding apparatus 3. For example, the control section 26 controls various operations of the bundle forming section 22, the sheet shifting section 23, and the tape processing section 24.

An operation example of the sheet binding apparatus 3 is explained. FIGS. 4 to 10 are front views showing the operation example of the sheet binding apparatus 3.

First, as shown in FIG. 2, the sheet binding apparatus 3 moves the stopper 33 to the restricting position to block the sheet S conveyed to the main guide 31. Consequently, the plurality of sheets S are stacked in order and the sheet bundle 5 is formed. Subsequently, the sheet binding apparatus 3 moves the stopper 33 to the releasing position. The sheet binding apparatus 3 switches the switching member 34 toward the second conveying direction.

Subsequently, as shown in FIG. 3, the sheet binding apparatus 3 moves the second roller 42 toward the first roller 41. Consequently, the sheet bundle 5 and the outer circumferential surface 42*s* of the second roller 42 is deformed into an arcuate shape conforming to the outer circumferential surface 41*s* of the first roller 41. The sheet binding apparatus 3 normally rotates the first roller 41 in a state in which the sheet bundle 5 is held between the first roller 41 and the second roller 42.

Consequently, the second roller 42 rotates according to the rotation of the first roller 41 while maintaining a state in which the outer circumferential surface 42*s* of the second roller 42 is recessed along the outer circumferential surface 41*s* of the first roller 41. As a result, a state in which the plurality of sheets S are shifted in a step shape in the sheet conveying direction X1 at the edge portion 5*a* of the sheet bundle 5 is formed. "The edge portion 5*a* of the sheet bundle 5" in the following explanation means the edge portion 5*a* of the sheet bundle 5 in which the plurality of sheets S are shifted in the step shape.

Subsequently, the sheet binding apparatus 3 moves the second roller 42 in a direction away from the first roller 41. Consequently, the recess of the outer circumferential surface 42*s* of the second roller 42 is eliminated. Subsequently, the sheet binding apparatus 3 reversely rotates the first roller 41 and the second roller 42 to move the sheet bundle 5 toward an opposite direction X2 of the sheet conveying direction X1. Subsequently, the sheet binding apparatus 3 switches the switching member 34 to switch the conveying path from the second conveying direction to the first conveying direction. The sheet binding apparatus 3 normally rotates the first roller 41 and the second roller 42 to move the sheet bundle 5 toward the tape attaching section 59.

As shown in FIG. 4, before the sheet bundle 5 is inserted between the first roller 91 and the second roller 92, the sheet binding apparatus 3 sets the roller interval to the thickness of the sheet bundle 5 or less. In this embodiment, before the sheet bundle 5 is inserted between the first roller 91 and the second roller 92, the sheet binding apparatus 3 brings the first roller 91 and the second roller 92 into contact with each other to set the roller interval to zero. Before the sheet bundle 5 is inserted between the first roller 91 and the second roller 92, the sheet binding apparatus 3 forms the nip 90N with the first roller 91 and the minimum radius section 92*a* of the second roller 92.

The sheet binding apparatus 3 in this embodiment changes, on the basis of the shift amount d among the sheets S changed by the control section 26 (see FIG. 1), the length L of the tape T cut by the cutter 56. For example, in this embodiment, the control section 26 controls the driving source 73 (see FIG. 2) of the cutting-length changing section 57, whereby the position of the cutter 56 is changed.

Figure 5:
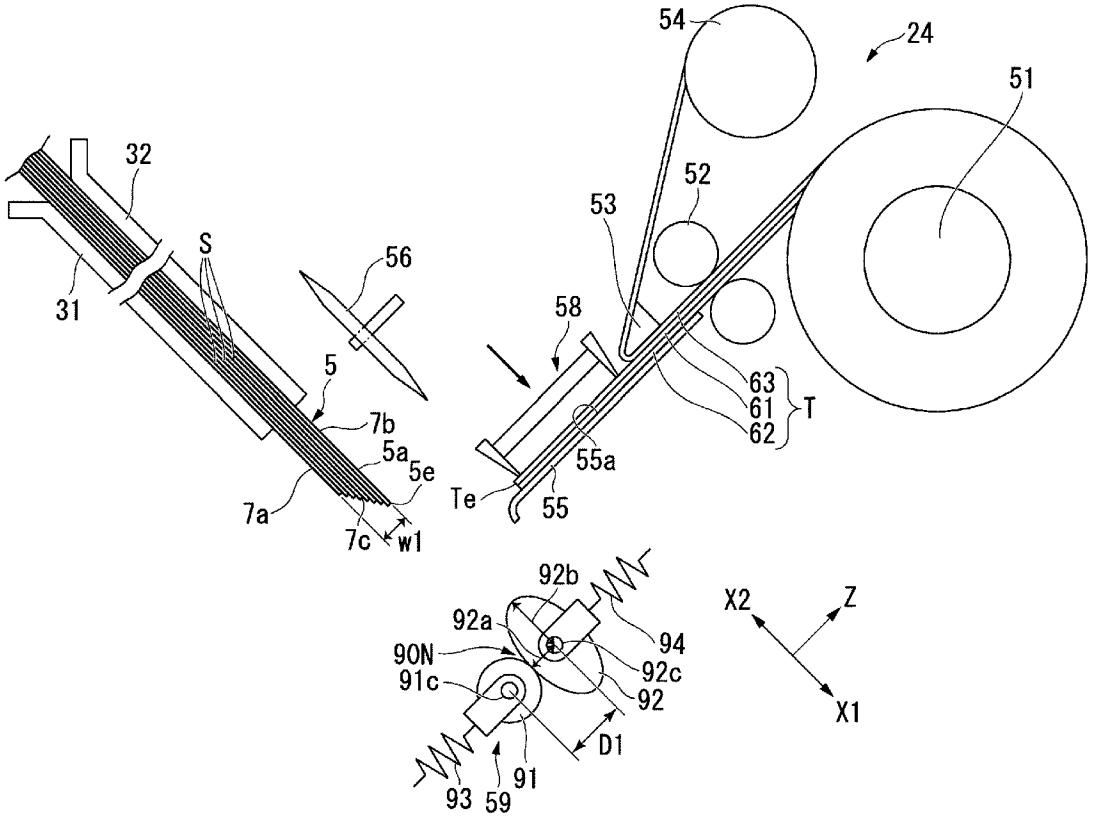
FIG. 5 is a front view showing the operation of the sheet binding apparatus following FIG. 4.

Subsequently, as shown in FIG. 5, the sheet binding apparatus 3 brings the tape holding section 58 into contact with the tape T to support the tape T in a state in which the posture of the tape T is retained. In this embodiment, the sheet binding apparatus 3 brings the tape holding section 58 into contact with both ends (an upstream end and a downstream end in the conveying direction of the tape T) of the guide table 55 to support the substantially flat (linear) tape T.

Figure 6:
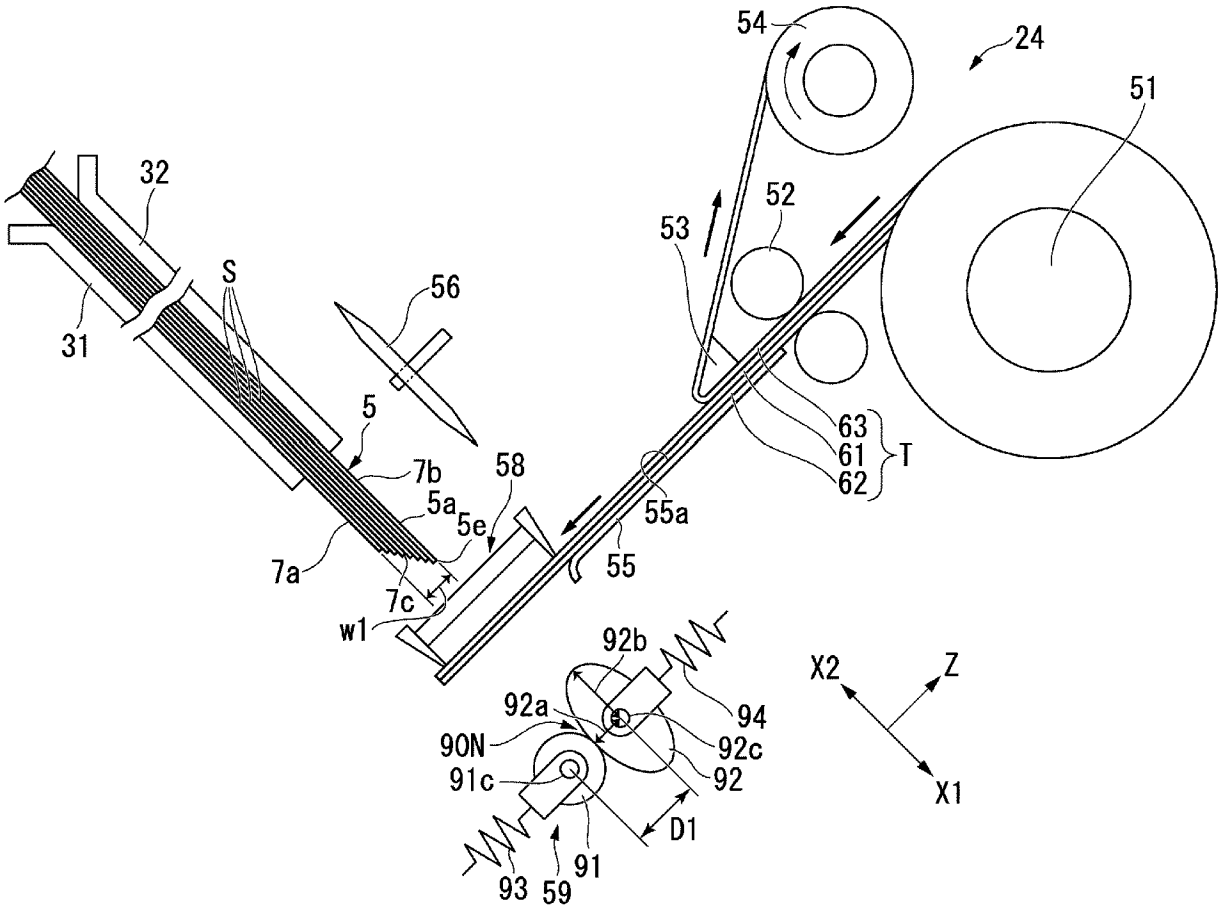
FIG. 6 is a front view showing the operation of the sheet binding apparatus following FIG. 5.

Subsequently, as shown in FIG. 6, the sheet binding apparatus 3 moves the tape holding section 58 to between the sheet bundle 5 and the tape attaching section 59. For example, the tape holding section 58 disposes the tape T to extend across the first roller 91 and the second roller 92. For example, the tape holding section 58 disposes the tape T such that the center of the linear tape T faces the nip 90N of the first roller 91 and the second roller 92. In other words, the tape holding section 58 causes the center between the first tape supporting section 58*a* and the second tape supporting section 58*b*, which hold the tape T, to face the nip 90N of the first roller 91 and the second roller 92.

Figure 7:
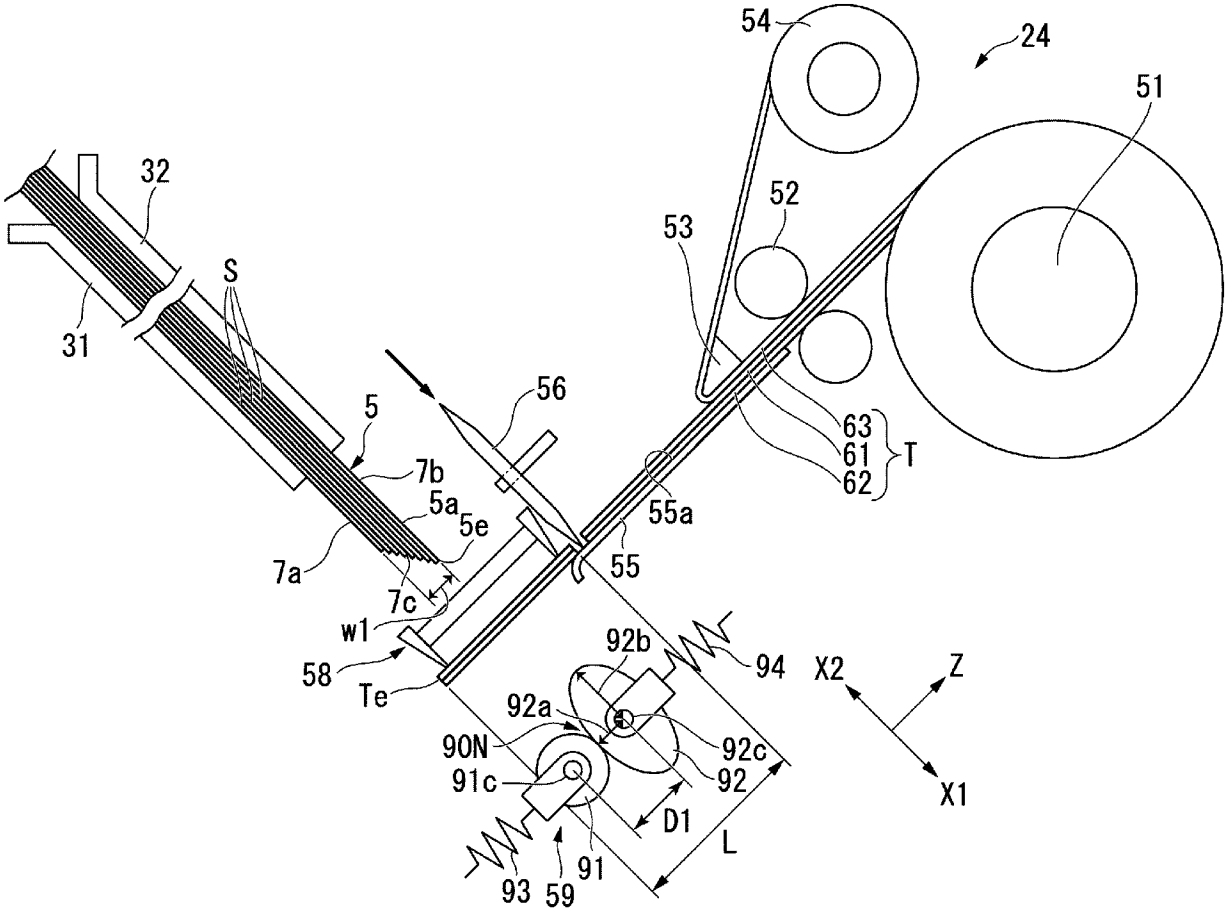
FIG. 7 is a front view showing the operation of the sheet binding apparatus following FIG. 6.

Subsequently, as shown in FIG. 7, the sheet binding apparatus 3 cuts the belt-like tape T with the cutter 56 to form the sheet-like tape T. Consequently, the tape T is cut into a necessary length.

Figure 8:
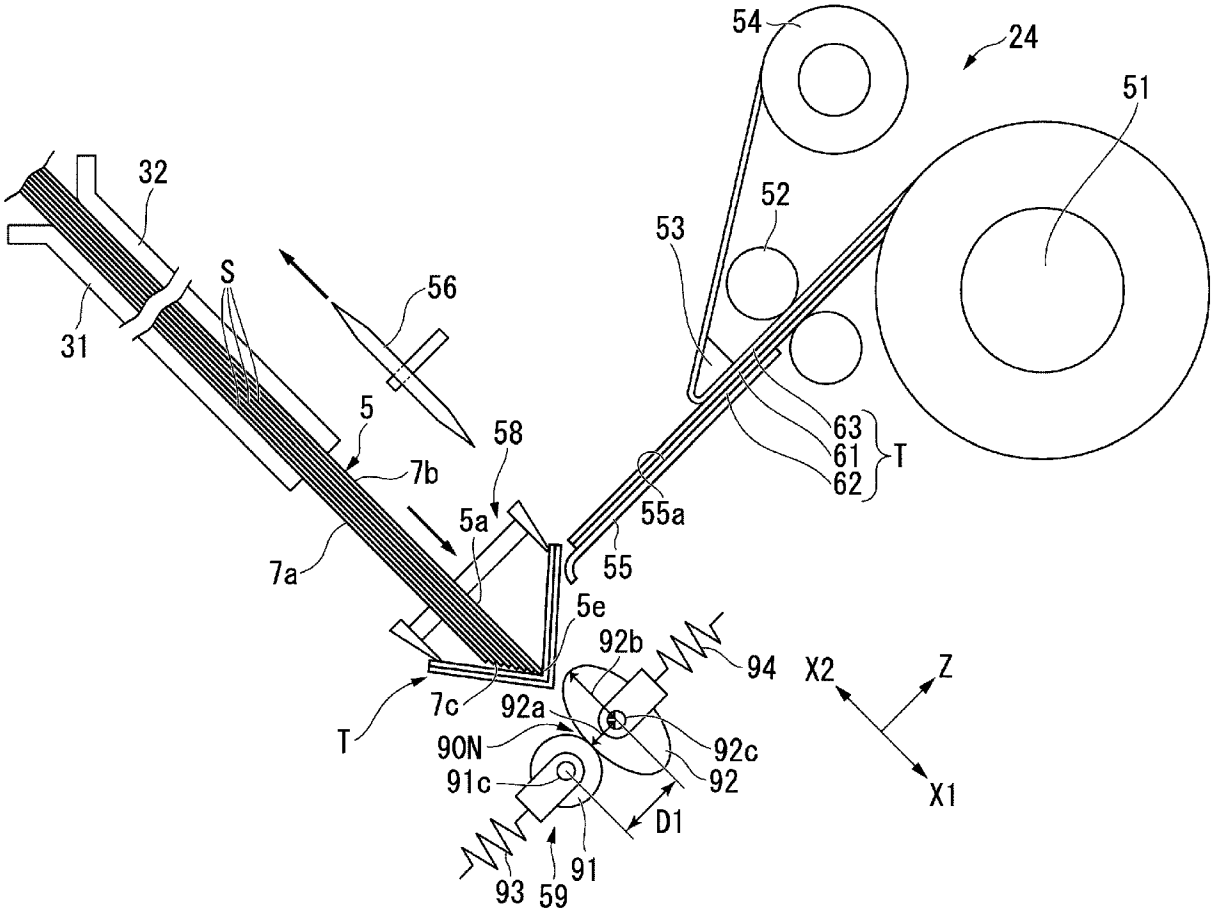
FIG. 8 is a front view showing the operation of the sheet binding apparatus following FIG. 7.

Subsequently, as shown in FIG. 8, the sheet binding apparatus 3 moves the sheet bundle 5 toward the tape attaching section 59 with the sheet shifting section 23 (see FIG. 2). For example, the sheet binding apparatus 3 normally rotates the first roller 41 and the second roller 42 (see FIG. 2) to move (insert) the sheet bundle 5 toward the tape attaching section 59. The sheet binding apparatus 3 conveys the sheet bundle 5 located between the main guide 31 and the sub-guide 32 toward between the first roller 91 and the second roller 92. The sheet binding apparatus 3 causes the edge portion leading end 5*e* of the sheet bundle 5 to face the inner side of the inter-center width D1 between the first roller 91 and the second roller 92. The sheet binding apparatus 3 inserts the sheet bundle 5 into the tape T held by the tape holding section 58 to thereby peel the tape T from the tape holding section 58. The sheet binding apparatus 3 inserts the edge portion 5*a* of the sheet bundle 5 between the first roller 91 and the second roller 92 together with the tape T.

Figure 9:
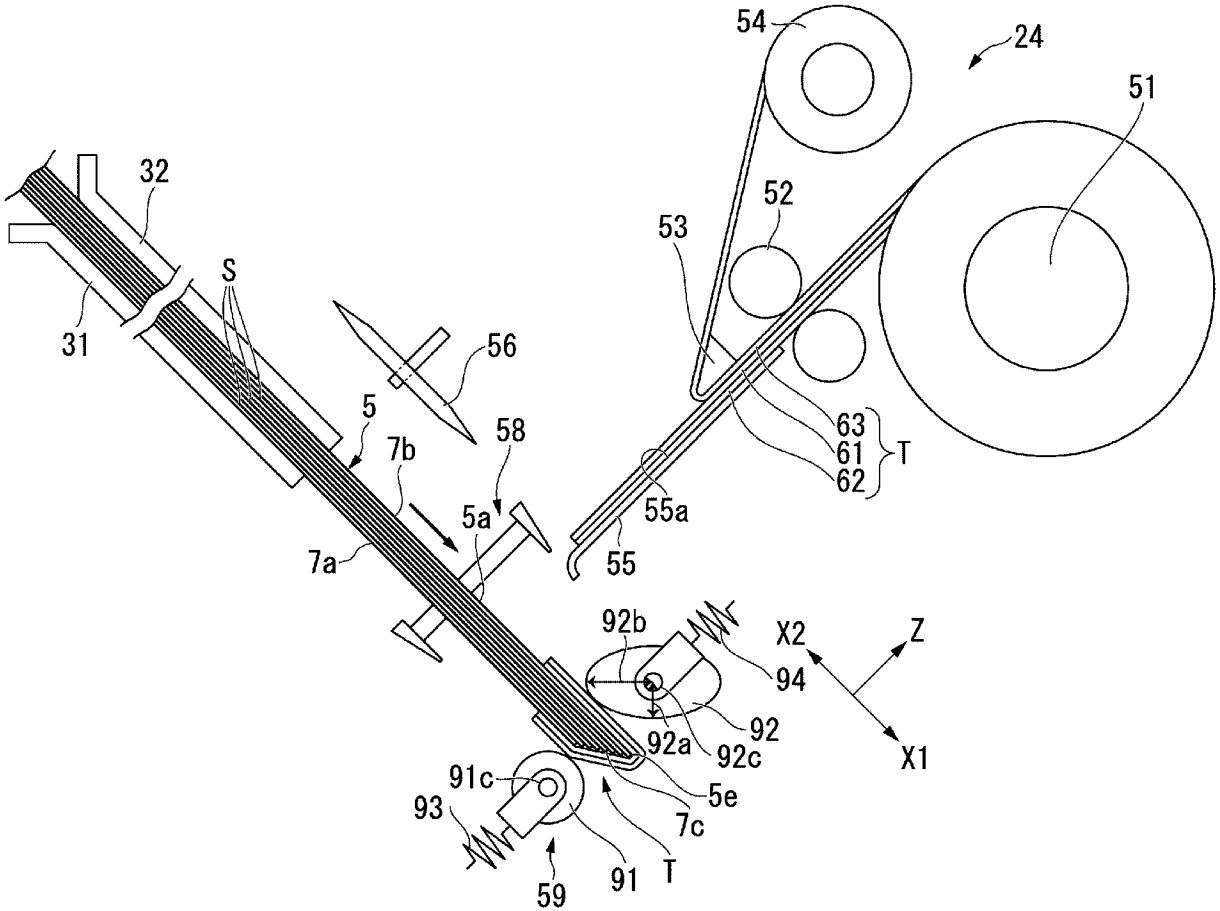
FIG. 9 is a front view showing the operation of the sheet binding apparatus following FIG. 8.

As shown in FIG. 9, if the edge portion 5*a* of the sheet bundle 5 is inserted between the first roller 91 and the second roller 92 together with the tape T, the first roller 91 and the second roller 92 move along the external shape of the edge portion 5*a* of the sheet bundle 5. Consequently, the first roller 91 and the second roller 92 press the tape T against the edge portion 5*a* of the sheet bundle 5. As a result, the tape T sequentially follows and adheres to the step-like portion of the sheet bundle 5. The edge portion 5*a* of the sheet bundle 5 includes the first surface 7*a*, the second surface 7*b*, and an end face 7*c*. The first surface 7*a* and the second surface 7*b* are surfaces extending along the sheet conveying direction X1. The second surface 7*b* is located on the opposite side of the first surface 7*a*. The end face 7*c* is located between the first surface 7*a* and the second surface 7*b*. The plurality of sheets S are shifted in a step shape. The sheets S are attached over the first surface 7*a*, the end face 7*c*, and the second surface 7*b* at the edge portion 5*a* of the sheet bundle 5. Consequently, all the sheets S including an intermediate page of the sheet bundle 5 are integrated by the tape T. Consequently, processing for attaching the tape T to the edge portion 5*a* of the sheet bundle 5 is completed.

In this embodiment, if the edge portion 5*a* of the sheet bundle 5 is inserted between the first roller 91 and the second roller 92 together with the tape T, the first roller 91 and the second roller 92 respectively rotate around rotating shafts 91*c* and 92*c*. After the insertion of the sheet bundle 5, a portion having a larger radius than the minimum radius section 92*a* of the second roller 92 (a portion closer to the maximum radius section 92*b*) forms the nip 90N. Consequently, after the insertion of the sheet bundle 5, a nip pressure is larger than a nip pressure before the insertion of the sheet bundle 5. Therefore, before the insertion of the sheet bundle 5, since the nip pressure is smaller than the nip pressure after the insertion of the sheet bundle 5, it is easy to insert the sheet bundle 5 between the rollers. On the other hand, after the insertion of the sheet bundle 5, since the nip pressure is larger than the nip pressure before the insertion of the sheet bundle 5, it is possible to apply a sufficient sticking force of the tape T to the edge portion 5*a* of the sheet bundle 5.

Figure 10:
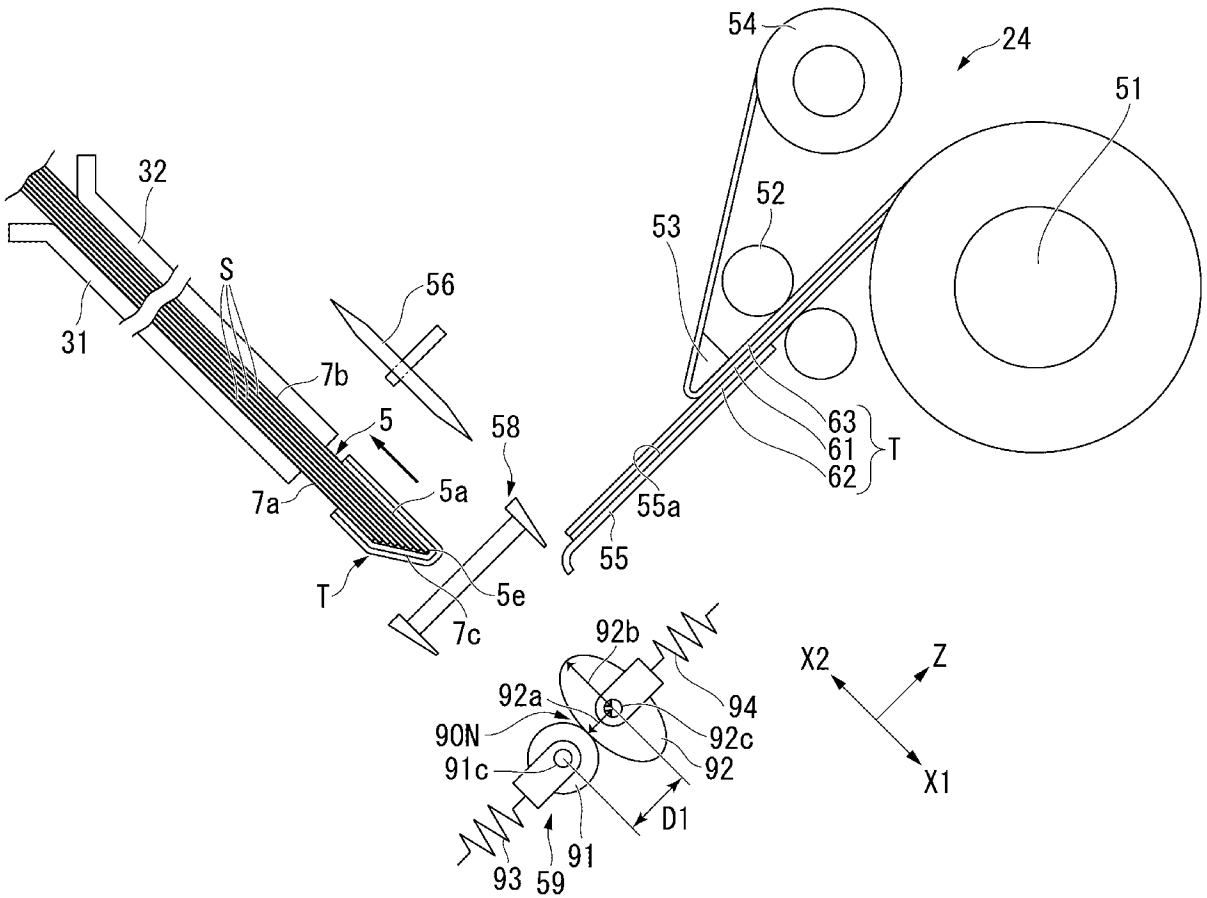
FIG. 10 is a front view showing the operation of the sheet binding apparatus following FIG. 9.

Subsequently, as shown in FIG. 10, the sheet binding apparatus 3 reversely rotates the first roller 41 and the second roller 42 to extract the sheet bundle 5 from between the first roller 91 and the second roller 92. The sheet binding apparatus 3 further reversely rotates the first roller 41 and the second roller 42 to discharge the sheet bundle 5 to a discharging section of the sheet binding apparatus 3.

Consequently, a series of operation by the sheet binding apparatus 3 ends.

The operation of a sheet binding apparatus in a comparative example is explained.

Figure 11:
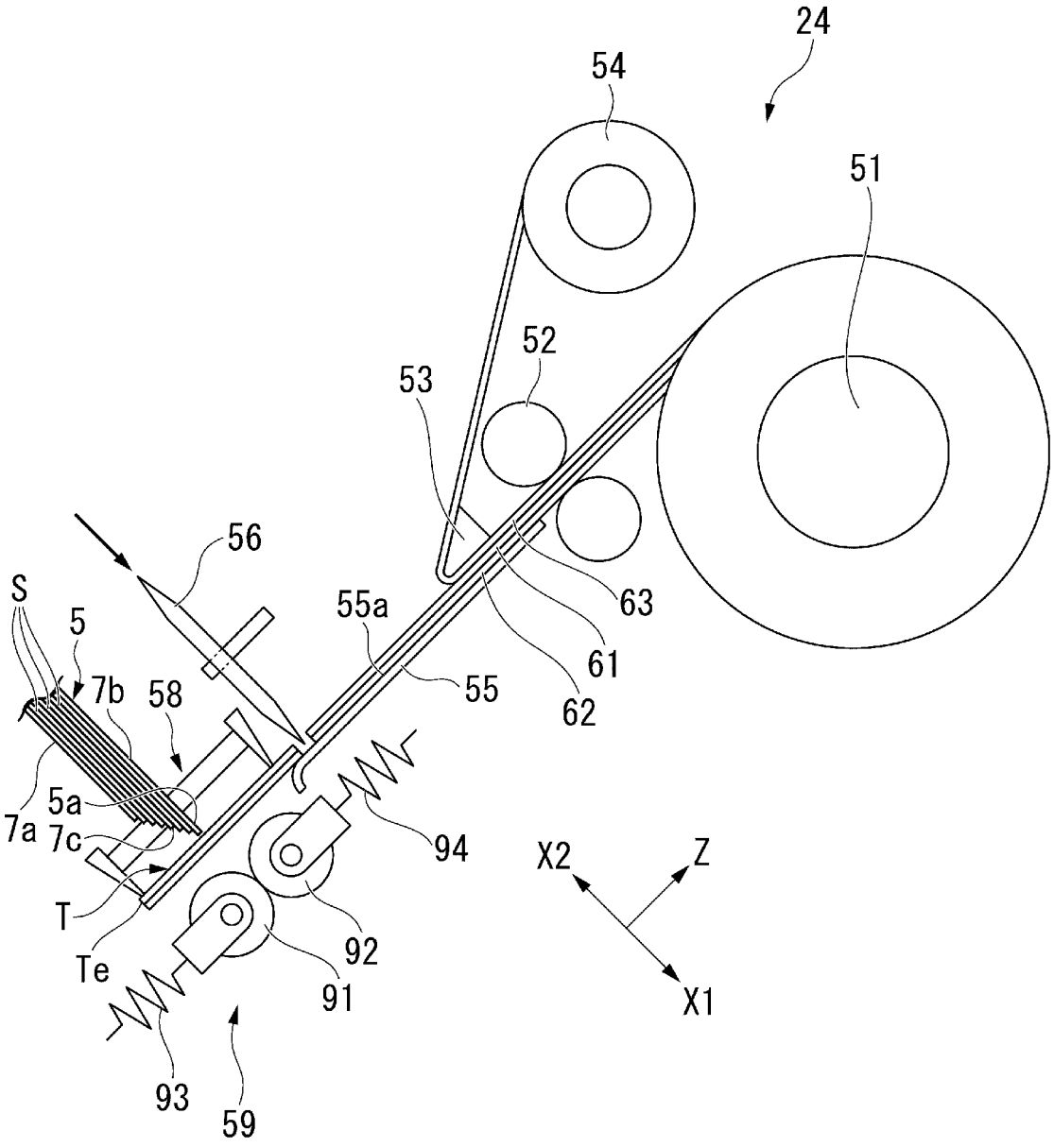
FIG. 11 is a front view showing the operation of a sheet binding apparatus in a comparative example.

FIG. 11 is a front view showing the operation of the sheet binding apparatus in the comparative example.

As shown in FIG. 11, the sheet binding apparatus in the comparative example does not include the nip-pressure adjusting section 80 (see FIG. 4).

In the comparative example, the first roller 91 and the second roller 92 respectively have perfect circle shapes. Therefore, the following problem is likely to occur depending on the magnitude of a pressing force (a nip pressure) on the sheet bundle 5 between the first roller 91 and the second roller 92 (between the rollers). For example, if the nip pressure is too small, the tape T cannot be sufficiently stuck to the edge portion 5*a* of the sheet bundle 5. On the other hand, for example, if the nip pressure is too large, the sheet bundle 5 cannot be rushed into between the first roller 91 and the second roller 92.

On the other hand, in the embodiment, as shown in FIG. 4, the sheet binding apparatus 3 includes the nip-pressure adjusting section 80 capable of adjusting the nip pressure on the basis of the position of the edge portion leading end 5*e* of the sheet bundle 5. Therefore, it is less likely that the nip pressure is too small and the tape T cannot be sufficiently stuck to the edge portion 5*a* of the sheet bundle 5. In addition, it is less likely that the nip pressure is too large and the sheet bundle 5 cannot be rushed into between the first roller 91 and the second roller 92.

According to the embodiment, the sheet binding apparatus 3 includes the first roller 91, the second roller 92, and the nip-pressure adjusting section 80. The first roller 91 attaches the tape T to the edge portion 5*a* of the sheet bundle 5. The second roller 92 is opposed to the first roller 91 in the sheet bundle thickness direction Z. The nip-pressure adjusting section 80 is capable of adjusting, on the basis of the position of the edge portion leading end 5*e* of the sheet bundle 5, a pressing force (a nip pressure) of the nip 90N formed by the first roller 91 and the second roller 92. Before the sheet 5 is inserted between the first roller 91 and the second roller 92, an interval between the first roller 91 and the second roller 92 (a roller interval) is equal to or smaller than the thickness of the sheet bundle 5. With the configuration explained above, the following effects are achieved.

The nip pressure can be adjusted by the nip-pressure adjusting section 80 on the basis of the position of the edge portion leading end 5*e* of the sheet bundle 5. Compared with when the nip pressure is fixed irrespective of the position of the edge portion leading end 5*e* of the sheet bundle 5, it is less likely that the nip pressure is too small and the tape T cannot be sufficiently stuck to the edge portion 5*a* of the sheet bundle 5. In addition, it is less likely that the nip pressure is too large and the sheet bundle 5 cannot be rushed into between the first roller 91 and the second roller 92. Therefore, it is easy to insert the sheet bundle 5 between the rollers before the insertion of the sheet bundle 5. It is possible to apply a sufficient sticking force of the tape T to the edge portion 5*a* of the sheet bundle 5 after the insertion of the sheet bundle 5. In addition, before the sheet bundle 5 is inserted between the first roller 91 and the second roller 92, compared with when the roller interval is larger than the thickness of the sheet bundle 5, it is easy to cause the tape T to follow the edge portion 5*a* of the sheet bundle 5. Therefore, it is possible to more surely bind the sheet bundle 5.

The second roller 92 has a shape, the radius of which before the insertion of the sheet bundle 5 is smaller than a threshold and the radius of which after the insertion of the sheet bundle 5 is equal to or larger than the threshold. With the configuration explained above, the following effects are achieved.

It is possible to adjust the nip pressure on the basis of the position of the edge portion leading end 5*e* of the sheet bundle 5 making use of the shape of the second roller 92. Compared with a configuration including a motor, an apparatus configuration is simplified. The configuration contributes to a reduction in cost. In addition, since complicated control is unnecessary, the configuration contributes to energy saving.

The second roller 92 includes the minimum radius section 92*a* having the minimum radius and the maximum radius section 92*b* having the maximum radius. Before the sheet bundle 5 is inserted between the first roller 91 and the second roller 92, the minimum radius section 92*a* forms the nip 90N. With the configuration explained above, the following effects are achieved.

Before the insertion of the sheet bundle 5, a balanced state is retained by the first roller 91 and the minimum radius section 92*a* of the second roller 92. Therefore, after the insertion of the sheet bundle 5, a portion having a larger radius than the minimum radius section 92*a* of the second roller 92 (a portion closer to the maximum radius section 92*b*) forms the nip 90N. Consequently, after the insertion of the sheet bundle 5, it is possible to set a nip pressure larger than a nip pressure before the insertion of the sheet bundle 5. In addition, after the sheet bundle 5 is extracted from between the first roller 91 and the second roller 92, it is possible to return the first roller 91 and the second roller 92 to the balanced state before the insertion of the sheet bundle 5.

The second roller 92 has an elliptical shape. With the configuration explained above, the following effects are achieved.

It is possible to adjust the nip pressure with a simple configuration that makes use of the elliptical shape. In addition, compared with the configuration including the motor, since complicated control is unnecessary, the configuration contributes to energy saving.

The first roller 91 has a perfect circle shape. The first roller 91 is opposed to the step-like end face 7*c* of the sheet bundle 5. With the configuration explained above, the following effects are achieved.

Compared with when the first roller 91 having the elliptical shape is opposed to the step-like end face 7*c* of the sheet bundle 5, it is easy to cause the tape T to follow the step-like end face 7*c* of the sheet bundle 5. Therefore, it is possible to smoothly attach the tape T to the edge portion 5*a* of the sheet bundle 5.

The second roller 92 has an elliptical shape. The second roller 92 is opposed to a surface on the opposite side of the step-like end face 7*c* of the sheet bundle 5. With the configuration explained above, the following effect is achieved.

Compared with when the second roller 92 having the perfect circle shape is opposed to the surface on the opposite side of the step-like end face 7*c* of the sheet bundle 5, it is easy to adjust the nip pressure making use of the shape of the second roller 92.

The sheet binding apparatus 3 further includes the first spring 93, the second spring 94, and the main guide 31. The first spring 93 urges the first roller 91 toward the second roller 92. The second spring 94 urges the second roller 92 toward the first roller 91. The main guide 31 guides the sheet bundle 5 to cause the edge portion leading end 5*e* of the sheet bundle 5 to face the inner side of the inter-center width D1 between the first roller 91 and the second roller 92. With the configuration explained above, the following effects are achieved.

Since it is possible to cause the tape T to follow the edge portion 5*a* of the sheet bundle 5, it is possible to more surely bind the sheet bundle 5. In addition, compared with when the sheet bundle 5 is guided to cause the edge portion leading end 5*e* of the sheet bundle 5 to face the outer side of the inter-center width D1 between the first roller 91 and the second roller 92, it is easy to rush the sheet bundle 5 into between the first roller 91 and the second roller 92.

The sheet binding apparatus 3 further includes the bundle conveying section 40 that conveys the sheet bundle 5 located between the main guide 31 and the sub-guide 32 toward between the first roller 91 and the second roller 92. With the configuration explained above, the following effects are achieved.

In a state in which the posture of the sheet bundle 5 is retained, it is possible to convey the sheet bundle 5 toward between the first roller 91 and the second roller 92. Therefore, it is possible to attach the tape T to the edge portion 5*a* of the sheet bundle 5 while preventing curl of the sheet bundle 5.

A first modification of the first embodiment is explained.

The first roller 91 is not limited to having the perfect circle shape.

Figure 12:
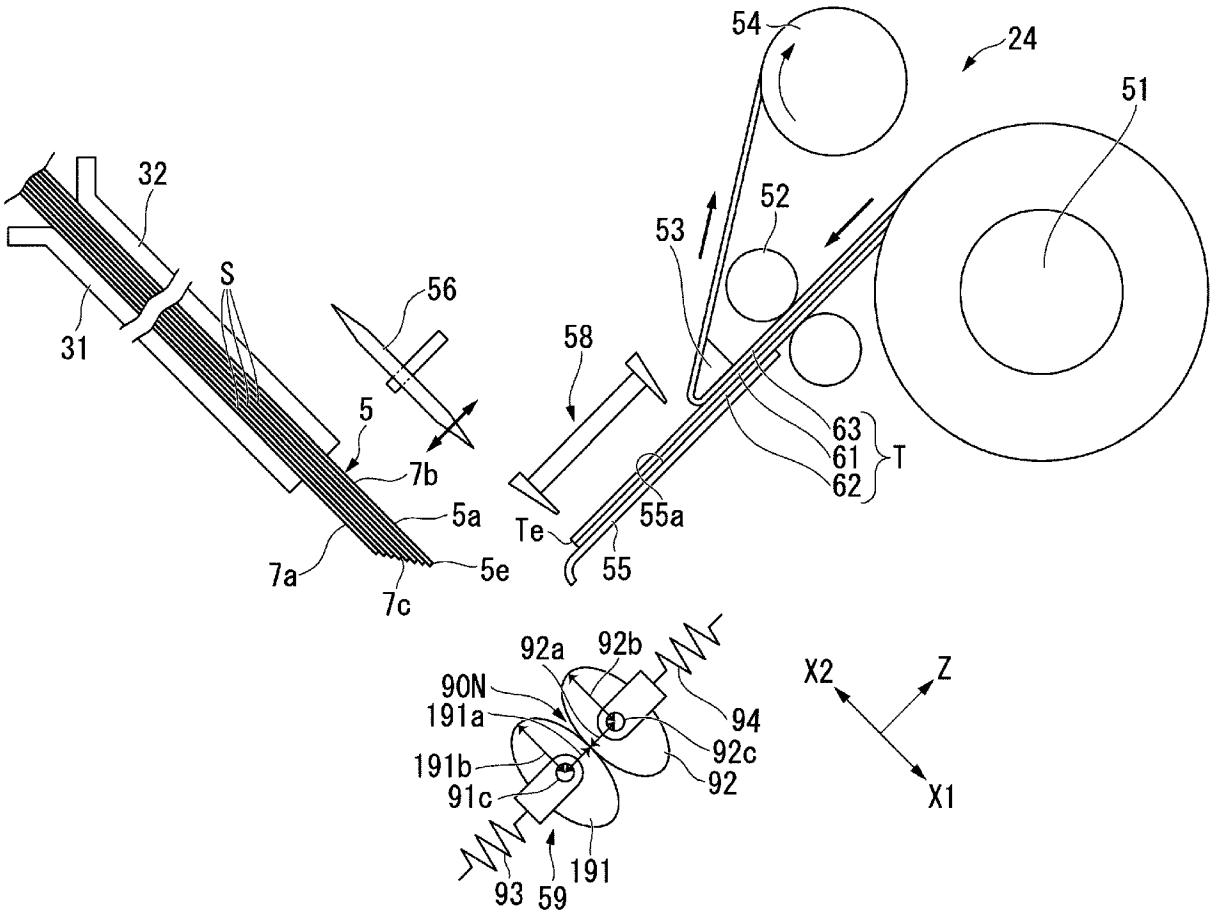
FIG. 12 is a front view showing an internal configuration of a sheet binding apparatus in a first modification of the first embodiment.

FIG. 12 is a front view showing a sheet binding apparatus in a first modification of the first embodiment. As shown in FIG. 12, a first roller 191 may have an elliptical shape. In this modification, the first roller 191 and the second roller 92 respectively have elliptical shapes. The first roller 191 and the second roller 92 respectively include minimum radius sections 191*a* and 92*a* and maximum radius sections 191*b* and 92*b*. Before the sheet bundle 5 is inserted between the first roller 191 and the second roller 92, the minimum radius sections 191*a* and 92*a* of the first roller 191 and the second roller 92 form the nip 90N.

According to the first modification of the first embodiment, the first roller 191 and the second roller 92 respectively have the elliptical shapes. With the configuration explained above, the following effect is achieved.

Compared with when one of the first roller 191 and the second roller 92 has the elliptical shape, it is easy to adjust the nip pressure making use of the respective shapes of the first roller 191 and the second roller 92.

A second modification of the first embodiment is explained.

The second roller 92 is not limited to having the elliptical shape.

Figure 13:
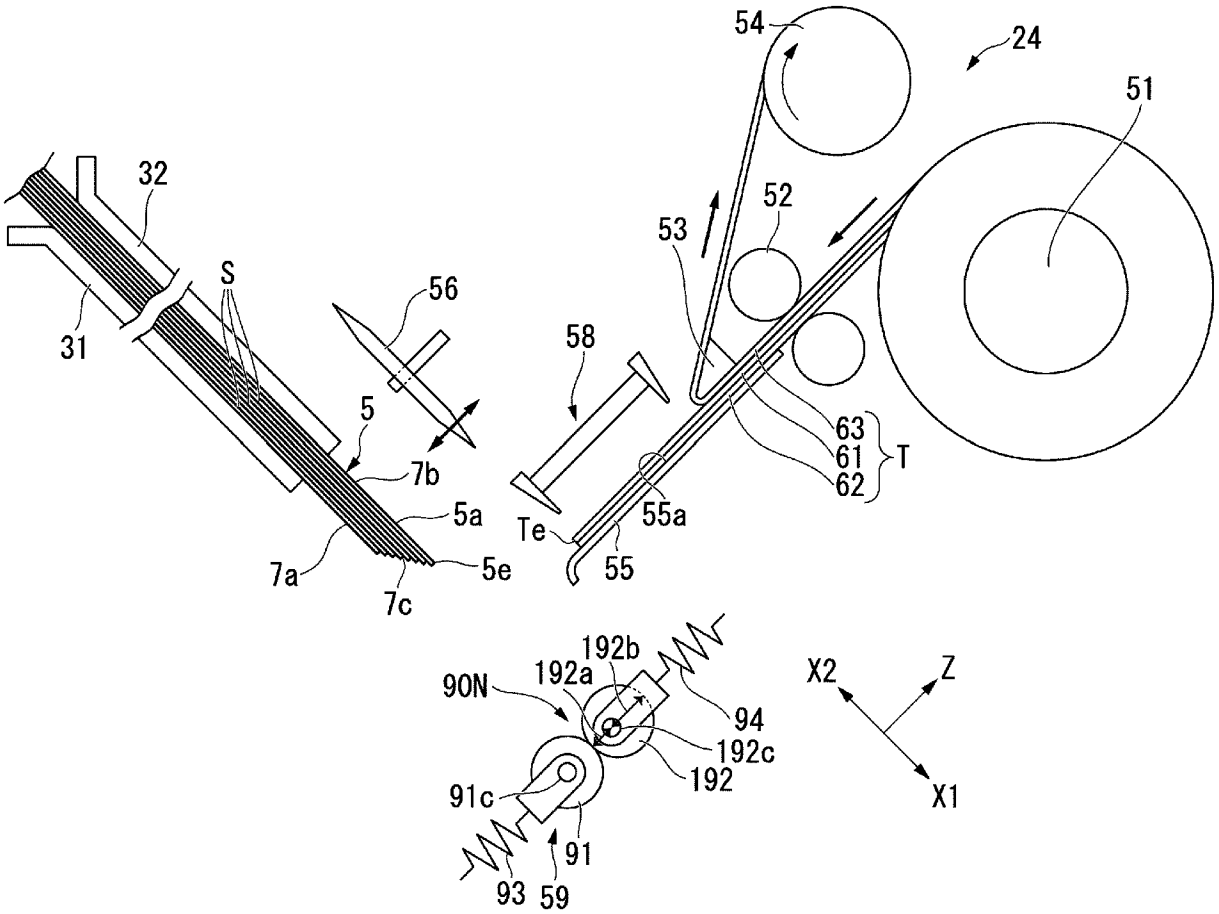

FIG. 13 is a front view showing a sheet binding apparatus in a second modification of the first embodiment. As shown in FIG. 13, a second roller 192 may have a cam shape. A rotating shaft 192*c* of the second roller 192 deviates from the center position of the second roller 192. The second roller 192 has a perfect circular external shape. The second roller 192 includes a minimum radius section 192*a* and a maximum radius section 192*b*. Before the sheet bundle 5 is inserted between the first roller 91 and the second roller 192, the minimum radius section 192*a* of the second roller 192 forms the nip 90N. The second roller 192 rotates with the rotating shaft 192*c* as an axis to adjust the nip pressure.

According to the second modification of the first embodiment, the second roller 192 has a cam shape. With the configuration explained above, the following effects are achieved.

It is possible to adjust the nip pressure with a simple configuration that makes use of the cam shape. In addition, compared with the configuration including the motor, since complicated control is unnecessary, the configuration contributes to energy saving.

A second embodiment is explained. In the second embodiment, explanation is omitted concerning the same components as the components in the first embodiment.

A sheet binding apparatus is not limited to including the second spring 94 (see FIG. 4) that urges the second roller 92 toward the first roller 91. The second embodiment is different from the first embodiment in that the sheet binding apparatus does not include the second spring 94 (an urging member). In other words, in the second embodiment, the first roller 91 among the first roller 91 and the second roller 92 includes the urging member.

Figure 14:
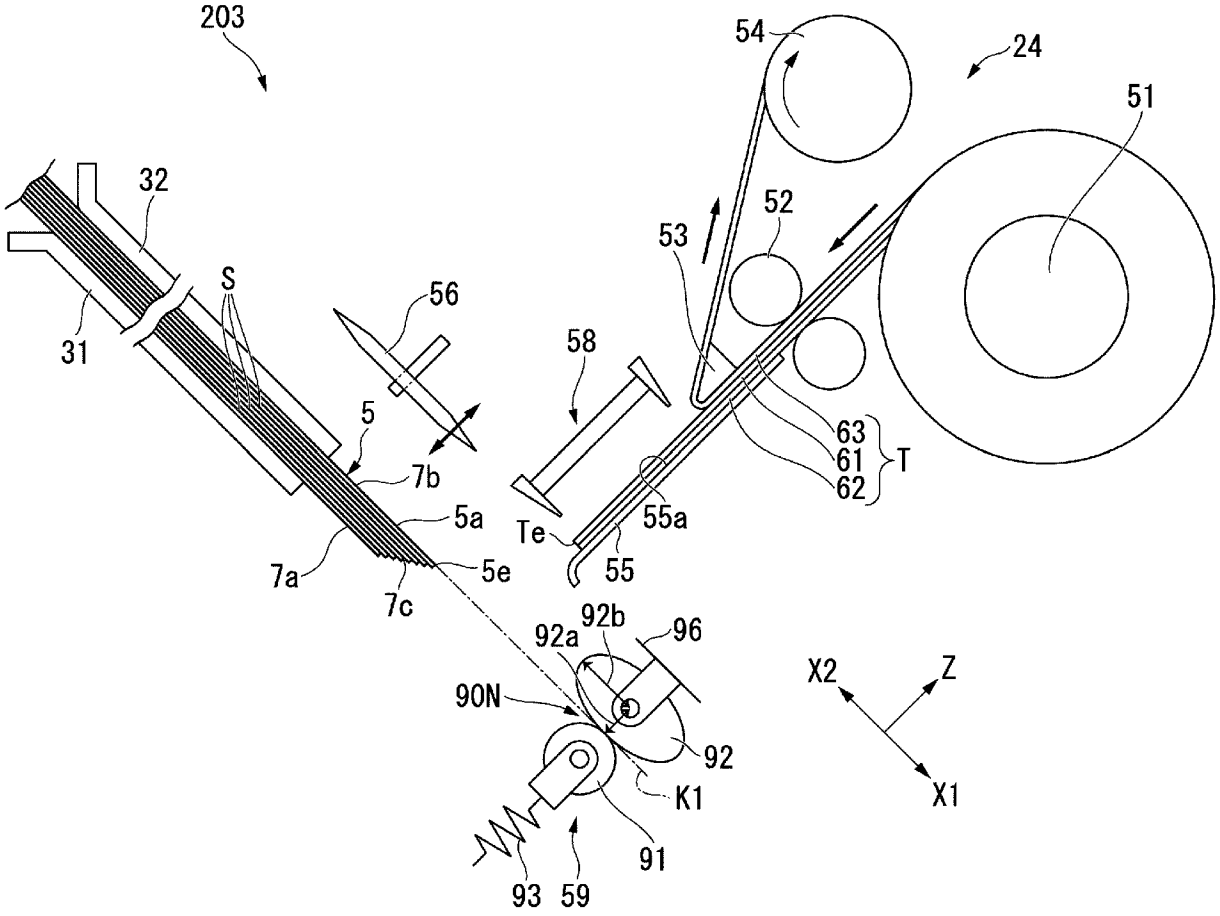
FIG. 14 is a front view showing an internal configuration of a sheet binding apparatus in a second embodiment.

FIG. 14 is a front view showing a sheet binding apparatus 203 in the second embodiment.

As shown in FIG. 14, the sheet binding apparatus 203 includes a supporting member 96 that rotatably supports the second roller 92. The supporting member 96 supports the second roller 92 in a fixed position.

The main guide 31 guides the sheet bundle 5 to cause the edge portion leading end 5*e* of the sheet bundle 5 to face a nip forming end of the second roller 92. The nip forming end of the second roller 92 means, on the outer circumferential surface of the second roller 92, a portion that forms the nip 90N in cooperation with the first roller 91. The nip forming end of the second roller 92 is equivalent to an end edge closest to the first roller 91 in the sheet bundle thickness direction Z in the second roller 92. Before insertion of the sheet bundle 5, the nip forming end of the second roller 92 is an end edge of the minimum radius section 92*a*. In the figure, reference sign K1 indicates an imaginary straight line that passes the edge portion leading end 5*e* of the sheet bundle 5 and the nip forming end of the second roller 92.

According to the second embodiment, the sheet binding apparatus 203 includes the urging member 93, the supporting member 96, and the main guide 31. The urging member 93 urges the first roller 91 toward the second roller 92. The supporting member 96 rotatably supports the second roller 92. The main guide 31 guides the sheet bundle 5 to cause the edge portion leading end 5*e* of the sheet bundle 5 to face the nip forming end of the second roller 92. With the configuration explained above, the following effects are achieved.

Since it is possible to cause, with the urging member 93 (the first spring), the tape T to follow the edge portion 5*a* of the sheet bundle 5, it is possible to more surely bind the sheet bundle 5. In addition, compared with when the edge portion leading end 5*e* of the sheet bundle 5 is guided to a position deviating from the nip forming end of the second roller 92, it is easy to rush the sheet bundle 5 into between the first roller 91 and the second roller 92.

A third embodiment is explained. In the third embodiment, explanation is omitted concerning the same components as the components in the first embodiment.

A sheet binding apparatus is not limited to adjusting a nip pressure with a shape of a roller. The third embodiment is different from the first embodiment in that the sheet binding apparatus includes a control section that controls the nip pressure.

Figure 15:
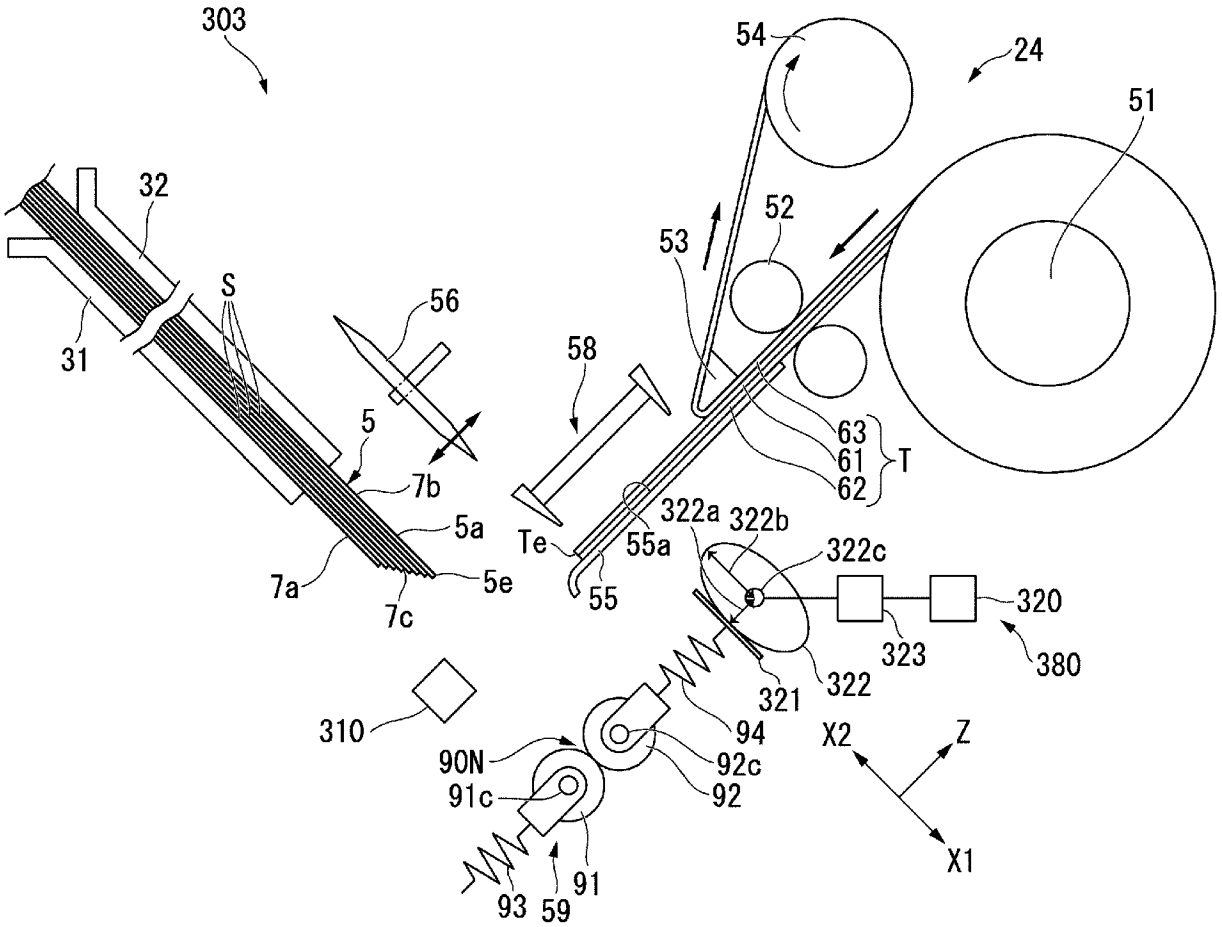
FIG. 15 is a front view showing an internal configuration of a sheet binding apparatus in a third embodiment.

FIG. 15 is a front view showing a sheet binding apparatus 303 in the third embodiment.

As shown in FIG. 15, the sheet binding apparatus 303 includes a nip-pressure adjusting section 380 capable of adjusting the nip pressure on the basis of the position of the edge portion leading end 5*e* of the sheet bundle 5. The nip-pressure adjusting section 380 may include a sensor 310 that detects the edge portion leading end 5*e* of the sheet bundle 5 and a control section 320 (hereinafter referred to as "nip-pressure control section 320" as well) that controls the nip pressure on the basis of a detection result of the sensor 310.

For example, the sensor 310 is a non-contact displacement sensor such as a laser-type displacement sensor. The sensor 310 is located between the main guide 31 and the first roller 91 in an inserting direction of the sheet bundle 5. The sensor 310 is located between the tape holding section 58 and the tape attaching section 59 in a state in which the tape holding section 58 disposes the tape T to extend across the first roller 91 and the second roller 92. In this embodiment, the first roller 91 and the second roller 92 respectively have perfect circle shapes.

In FIG. 15, reference numeral 321 indicates a supporting plate that supports the proximal end of the second spring 94. Reference numeral 322 indicates an elliptical cam having an elliptical shape. Reference numeral 323 indicates a cam driving source for rotating the elliptical cam 322. The elliptical cam 322 includes a minimum radius section 322*a* and a maximum radius section 322*b*. Before the sheet bundle 5 is inserted between the first roller 91 and the second roller 92, the minimum radius section 322*a* of the elliptical cam 322 is in contact with the supporting plate 321. The elliptical cam 322 rotates with a rotating shaft 322*c* as an axis to adjust the nip pressure. For example, the cam driving source 323 is a motor.

The nip-pressure control section 320 controls the cam driving source 323 on the basis of a detection result of the sensor 310. The nip-pressure control section 320 controls the cam driving source 323 to thereby adjust the nip pressure on the basis of the position of the edge portion leading end 5*e* of the sheet bundle 5.

In this embodiment, after the sensor 310 detects the edge portion leading end 5*e* of the sheet bundle 5, the nip-pressure control section 320 sets the nip pressure (a pressing force) to be larger than a threshold (a pressing threshold) after a set time elapses. For example, the set time is set to 1 ms or more and 100 ms or less. For example, the set time is set to a time until the sensor 310 detects a second sheet S from the edge portion leading end 5*e* of the sheet bundle 5 after detecting the edge portion leading end 5*e* of the sheet bundle 5.

The nip-pressure control section 320 sets the nip pressure to be larger than the threshold after insertion of a second or subsequent sheet S from the edge portion leading end 5*e* of the sheet bundle 5 in the sheet bundle 5. The nip-pressure control section 320 sets the nip pressure on the second or subsequent sheet S to be larger than the nip pressure on the first sheet S.

Figure 16:
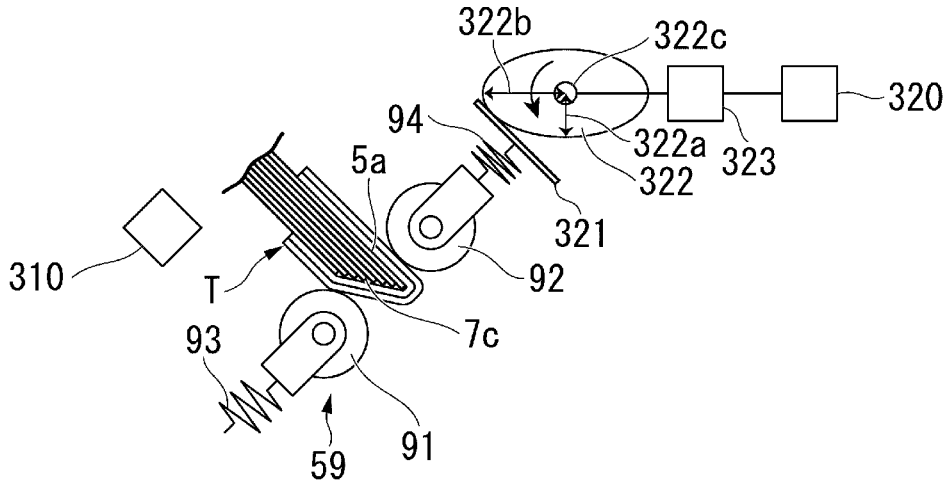
FIG. 16 is a diagram showing a state in which a first roller in the third embodiment is opposed to a step-like end face of a sheet bundle.

The nip-pressure control section 320 gradually increases the nip pressure according to an increase in the number of sheets after the insertion of the second or subsequent sheet S. While the first roller 91 is opposed to the step-like end face 7*c* of the sheet bundle 5, the nip-pressure control section 320 gradually increases the nip pressure according to an increase in the number of sheets (see FIG. 16).

Figure 17:
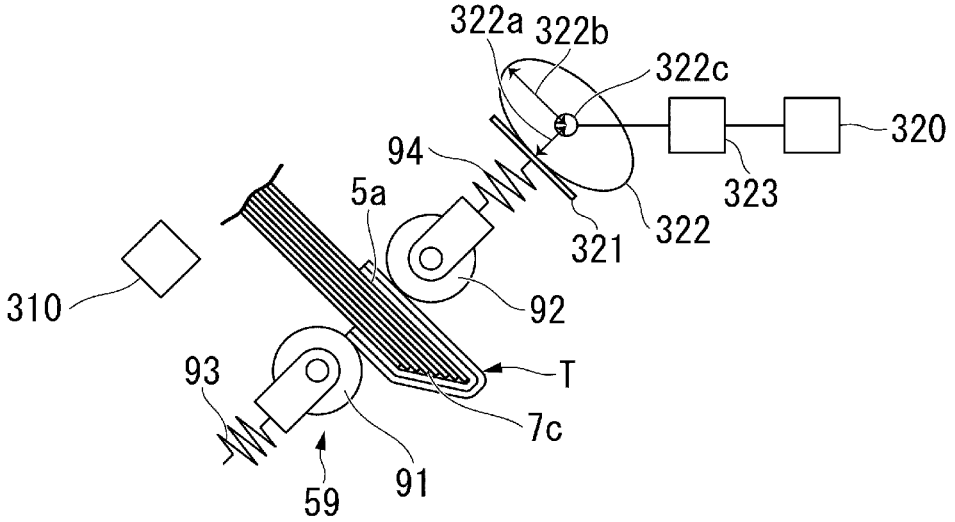
FIG. 17 is a diagram showing a state in which the first roller in the third embodiment passes the step-like end face of the sheet bundle.

The nip-pressure control section 320 may release the application of the nip pressure if the first roller 91 passes the step-like end face 7*c* of the sheet bundle 5 according to the insertion of the sheet bundle 5 (see FIG. 17). In other words, the nip-pressure control section 320 may release the application of the nip pressure while the first roller 91 is opposed to the surface of a last sheet included in the sheet bundle 5 (see FIG. 17).

According to the third embodiment, the nip-pressure adjusting section 380 includes the sensor 310 that detects the edge portion leading end 5*e* of the sheet bundle 5 and the nip-pressure control section 320 that controls the nip pressure on the basis of a detection result of the sensor 310. With the configuration explained above, the following effects are achieved.

It is possible to adjust the nip pressure with the nip-pressure control section 320 on the basis of the position of the edge portion leading end 5*e* of the sheet bundle 5. Compared with when the nip pressure is fixed irrespective of the position of the edge portion leading end 5*e* of the sheet bundle 5, it is less likely that the nip pressure is too small and the tape T cannot be sufficiently stuck to the edge portion 5*a* of the sheet bundle 5. In addition, it is less likely that the nip pressure is too large and the sheet bundle 5 cannot be rushed into between the first roller 91 and the second roller 92. Therefore, it is easy to insert the sheet bundle 5 between the rollers before the insertion of the sheet bundle 5. It is possible to apply a sufficient sticking force of the tape T to the edge portion 5*a* of the sheet bundle 5 after the insertion of the sheet bundle 5. Accordingly, it is possible to automatically bind the sheet bundle 5.

After the sensor 310 detects the edge portion leading end 5*e* of the sheet bundle 5, the nip-pressure control section 320 sets the nip pressure to be larger than the threshold after the set time elapses. With the configuration explained above, the following effects are achieved.

It is possible to optimize control timing of the nip pressure. For example, the set time is set to a time until the sensor 310 detects a second sheet S from the edge portion leading end 5*e* of the sheet bundle 5 after detecting the edge portion leading end 5*e* of the sheet bundle 5. Consequently, it is possible to apply a sufficient sticking force of the tape T to the step-like end face 7*c* of the sheet bundle 5.

The nip-pressure control section 320 sets the nip pressure to be larger than the threshold after the insertion of the second or subsequent sheet S from the edge portion leading end 5*e* of the sheet bundle 5 in the sheet bundle 5. With the configuration explained above, the following effect is achieved.

It is possible to apply a sufficient sticking force of the tape T to the second or subsequent sheet S from the edge portion leading end 5*e* of the sheet bundle 5.

The nip-pressure control section 320 gradually increases the nip pressure according to an increase in the number of sheets after the insertion of the second or subsequent sheet S. With the configuration explained above, the following effects is achieved.

It is possible to adjust the nip pressure with respect to the number of sheets stepwise. Therefore, compared with when adjustment of the nip pressure with respect to the number of sheets is performed in only one stage, it is easy to cause the tape T to follow the edge portion 5*a* of the sheet bundle 5. Therefore, it is possible to more effectively apply a sufficient sticking force of the tape T to the second or subsequent sheet S from the edge portion leading end 5*e* of the sheet bundle 5.

The first roller 91 and the second roller 92 respectively have perfect circle shapes. With the configuration explained above, the following effect is achieved.

It is possible to automatically bind the sheet bundle 5 using the simple first and second rollers 91 and 92.

A first modification of the third embodiment is explained.

A nip-pressure adjusting section is not limited to including the elliptical cam 322 that adjusts the nip pressure by rotating with the rotating shaft 322*c* as an axis.

Figure 18:
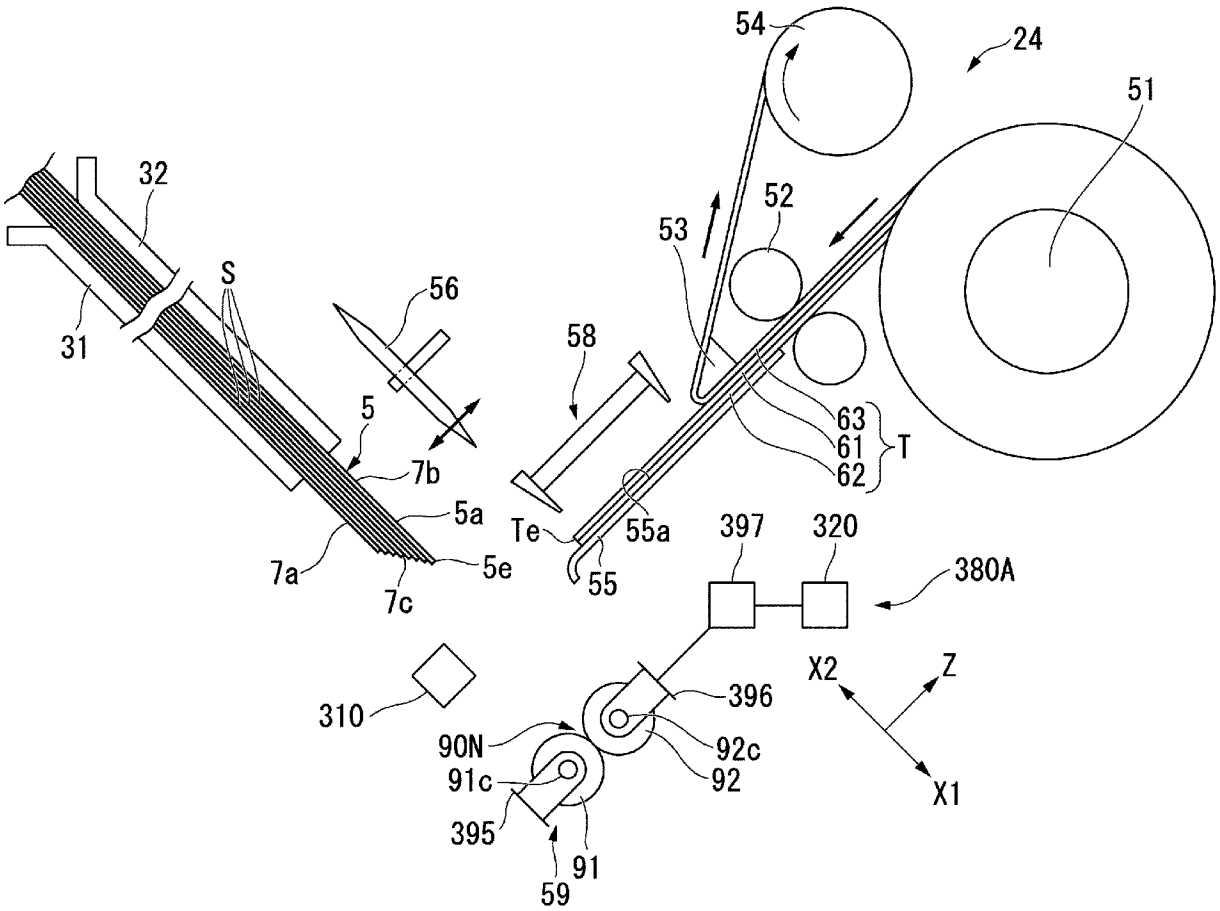
FIG. 18 is a front view showing an internal configuration of a sheet binding apparatus in a first modification of the third embodiment.

FIG. 18 is a front view showing a sheet binding apparatus in the first modification of the third embodiment. As shown in FIG. 18, a nip-pressure adjusting section 380A may not include the elliptical cam 322 (see FIG. 15). In FIG. 18, reference numeral 395 indicates a first supporting member that rotatably supports the first roller 91. Reference numeral 396 indicates a second supporting member that rotatably supports the second roller 92. Reference numeral 397 indicates a roller driving source that brings the second roller 92 close to or separates the second roller 92 from the first roller 91. For example, the roller driving source 397 includes a piston and crank mechanism. The nip-pressure control section 320 controls the roller driving source 397 to thereby adjust the nip pressure on the basis of the position of the edge portion leading end 5*e* of the sheet bundle 5.

According to the first modification of the third embodiment, the nip-pressure adjusting section 380A does not include the elliptical cam 322. With the configuration explained above, the following effects are achieved.

Compared with when the nip-pressure adjusting section includes the elliptical cam 322, the number of components is reduced. The configuration contributes to a reduction in cost.

Other modifications of the embodiments are explained below.

Before the sheet bundle 5 is inserted between the first roller 91 and the second roller 92, the roller interval is not limited to zero. For example, before the sheet bundle 5 is inserted between the first roller 91 and the second roller 92, the roller interval may be the same as the thickness of the sheet bundle 5. That is, before the sheet bundle 5 is inserted between the first roller 91 and the second roller 92, the roller interval may be larger than zero and equal to or smaller than the thickness of the sheet bundle 5.

A sheet binding apparatus is not limited to including the main guide 31 that is provided between the first roller 91 and the second roller 92 and guides the sheet bundle 5 and the sub-guide 32 opposed to the main guide 31 in the sheet bundle thickness direction Z. For example, the sheet binding apparatus may not include the sub-guide 32. For example, the sheet binding apparatus may include the main guide 31.

According to at least one embodiment explained above, the sheet binding apparatus 3 includes the first roller 91, the second roller 92, and the nip-pressure adjusting section 80. The first roller 91 attaches the tape T to the edge portion 5*a* of the sheet bundle 5. The second roller 92 is opposed to the first roller 91 in the sheet bundle thickness direction Z. The nip-pressure adjusting section 80 is capable of adjusting, on the basis of the position of the edge portion leading end 5*e* of the sheet bundle 5, the pressing force (the nip pressure) of the nip 90N formed by the first roller 91 and the second roller 92. Before the sheet bundle 5 is inserted between the first roller 91 and the second roller 92, the interval between the first roller 91 and the second roller 92 (the roller interval)

is equal to or smaller than the thickness of the sheet bundle 5. With the configuration explained above, the following effects are achieved.

It is possible to adjust the nip pressure with the nip-pressure adjusting section 80 on the basis of the position of the edge portion leading end 5*e* of the sheet bundle 5. Compared with when the nip pressure is fixed irrespective of the position of the edge portion leading end 5*e* of the sheet bundle 5, it is less likely that the nip pressure is too small and the tape T cannot be sufficiently stuck to the edge portion 5*a* of the sheet bundle 5. In addition, it is less likely that the nip pressure is too large and the sheet bundle 5 cannot be rushed into between the first roller 91 and the second roller 92. Therefore, it is easy to insert the sheet bundle 5 between the rollers before the insertion of the sheet bundle 5. It is possible to apply a sufficient sticking force of the tape T to the edge portion 5*a* of the sheet bundle 5 after the insertion of the sheet bundle 5. In addition, before the sheet bundle 5 is inserted between the first roller 91 and the second roller 92, compared with when the roller interval is larger than the thickness of the sheet bundle 5, it is easy to cause the tape T to follow the edge portion 5*a* of the sheet bundle 5. Therefore, it is possible to more surely bind the sheet bundle 5.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet binding apparatus, comprising:

a first roller configured to attach a tape to an edge portion of a sheet bundle;

a second roller opposed to the first roller in a sheet bundle thickness direction; and a nip-pressure adjusting section configured to adjust, on a basis of a position of a leading end edge portion of the sheet bundle, a pressing force of a nip formed by the first roller and the second roller, wherein before the sheet bundle is inserted between the first roller and the second roller, an interval between the first roller and the second roller is equal to or smaller than a thickness of the sheet bundle.

2. The apparatus according to claim 1, wherein at least one of the first roller and the second roller has a shape in which a distance from a rotating shaft to the nip before the insertion of the sheet bundle is smaller than a threshold and the distance after insertion of the sheet bundle is equal to or larger than the threshold.

3. The apparatus according to claim 2, wherein at least one of the first roller and the second roller comprises a minimum radius section having a minimum radius and a maximum radius section having a maximum radius, and before the sheet bundle is inserted between the first roller and the second roller, the minimum radius section forms the nip.

4. The apparatus according to claim 2, wherein at least one of the first roller and the second roller has an elliptical shape.

5. The apparatus according to claim 4, wherein the first roller has a circle shape and is opposed to a step-like end face of the sheet bundle, and the second roller has an elliptical shape and is opposed to a face on an opposite side of the step-like end face of the sheet bundle.

6. The apparatus according to claim 2, wherein at least one of the first roller and the second roller has a cam shape.

7. The apparatus according to claim 6, wherein the first roller has a circle shape and is opposed to a step-like end face of the sheet bundle, and the second roller has a cam shape and is opposed to a face on an opposite side of the step-like end face of the sheet bundle.

8. The apparatus according to claim 1, further comprising:

a first urging member configured to urge the first roller toward the second roller;

a second urging member configured to urge the second roller toward the first roller; and a guide configured to guide the sheet bundle to cause the leading end edge portion of the sheet bundle to face an inner side of an inter-center width between the first roller and the second roller.

9. The apparatus according to claim 1, further comprising:

an urging member configured to urge the first roller toward the second roller;

a supporting member configured to rotatably support the second roller; and a guide configured to guide the sheet bundle to cause the leading end edge portion of the sheet bundle to face a nip forming end of the second roller.

10. The apparatus according to claim 1, wherein the nip-pressure adjusting section comprises a sensor configured to detect the leading end edge portion of the sheet bundle and a control section configured to control the pressing force on a basis of a detection result of the sensor.

11. The apparatus according to claim 10, wherein, after the sensor detects the leading end edge portion of the sheet bundle, the control section sets the pressing force to be larger than a pressing threshold after a set time elapses.

12. An image forming system that forms an image on a sheet, the image forming system comprising the sheet binding apparatus according to claim 1.

13. A sheet binding method, comprising:

attaching a tape to an edge portion of a sheet bundle;

a second roller opposed to the first roller in a sheet bundle thickness direction;

a nip-pressure adjusting, on a basis of a position of a leading end edge portion of the sheet bundle, a pressing force of a nip formed by a first roller and a second roller opposed to each other in a sheet bundle thickness direction;

before inserting the sheet bundle between the first roller and the second roller, adjusting an interval between the first roller and the second roller to equal to or smaller than a thickness of the sheet bundle; and inserting the sheet bundle between the first roller and the second roller.

14. The method according to claim 13, wherein at least one of the first roller and the second roller has a shape in which a distance from a rotating shaft to the nip before inserting the sheet bundle is smaller than a threshold and the distance after insertion of the sheet bundle is equal to or larger than the threshold.

15. The method according to claim 14, wherein at least one of the first roller and the second roller comprises a minimum radius section having a minimum radius and a maximum radius section having a maximum radius, further comprising:

before inserting the sheet bundle between the first roller and the second roller, the minimum radius section forms the nip.

16. The method according to claim 14, wherein at least one of the first roller and the second roller has an elliptical shape or a cam shape.

17. The method according to claim 13, further comprising:

urging the first roller toward the second roller;

urging the second roller toward the first roller; and guiding the sheet bundle to cause the leading end edge portion of the sheet bundle to face an inner side of an inter-center width between the first roller and the second roller.

18. The method according to claim 13, further comprising:

urging the first roller toward the second roller;

rotatably supporting the second roller; and guiding the sheet bundle to cause the leading end edge portion of the sheet bundle to face a nip forming end of the second roller.

19. The method according to claim 13, further comprising:

detecting the leading end edge portion of the sheet bundle and controlling the pressing force on a basis of a detection result.

20. The method according to claim 19, further comprising:

after the sensor detects the leading end edge portion of the sheet bundle, the control section sets the pressing force to be larger than a pressing threshold after a set time elapses.

* * * * *